United States Patent [19]

Durley, III

[11] 4,375,950

[45] Mar. 8, 1983

[54] AUTOMATIC COMBUSTION CONTROL METHOD AND APPARATUS

[76] Inventor: Benton A. Durley, III, Rte. 45, Druce Lake, P.O. Box 304, Grayslake, Ill. 60030

[21] Appl. No.: 250,017

[22] Filed: Apr. 1, 1981

[51] Int. Cl.[3] ..... F23N 5/00; F23N 1/00

[52] U.S. Cl. ..... 431/12; 431/76; 236/15 BD

[58] Field of Search ..... 431/12, 76; 236/15 BD, 78 B

[56] References Cited

U.S. PATENT DOCUMENTS

| | | | |
|---|---|---|---|
| 4,033,712 | 7/1977 | Morton | 431/12 |
| 4,113,417 | 9/1978 | Deruelle | 431/12 X |
| 4,255,116 | 3/1981 | Zwick | 431/12 X |

*Primary Examiner*—William E. Wayner

*Attorney, Agent, or Firm*—Burmeister, York, Palmatier, Hamby & Jones

[57] ABSTRACT

A method of automatic combustion control in a combustion system comprising a combustion chamber, combustion means for causing the combustion of fuel in the chamber, a heat exchanger connecting with the combustion chamber, an exhaust passage connected with the heat exchanger, and fuel supply means for supplying fuel to the combustion means, such method comprising measuring the combustion temperature in the combustion chamber and producing a first quantity corresponding in magnitude with the combustion temperature, measuring the exhaust temperature in the exhaust passage and producing a second quantity corresponding in magnitude with the exhaust temperature, producing a summation of the first and second quantities and thereby producing a summation quantity, and varying the supply of air to the combustion means in such manner as to maximize the summation quantity, whereby the combustion efficiency is also maximized.

A minor amount of water is mixed with the air in the form of very small water droplets, 100 microns or less in size, to increase the combustion efficiency while controlling the buildup of combustion byproduct contaminants on the internal components of the combustion system.

18 Claims, 16 Drawing Figures

LOCK-IN GATE
364
FROM FIG. 8
334
334 TO FIG. 9
406
X-OR
408
410
412
414
NOR
FLIP FLOP
400
OR
AND
398
402
AND
404
405
NAND
452
454
448
TO FIG. 11
450
TO FIG. 11
450 TO FALSE PULSE GATE FIG. 11
LED
AND
AND
944
938 TO FIG. 11
TO FIG. 11
942 TO FIG. 11
946 TO FIG. 13
SCAN RATE CLOCK
362
388
CLOCK
390
392
394
384
384 TO FIG. 11
376
OPERATIONAL CLOCK AND PULSE DIVIDER
366
LED
368
CLOCK
DIVIDER
374
370
372
378
380
NAND
382

AIR VALVE POSITION FEEDBACK, DISCRIMINATORS AND ONE-SHOT.
COMBUSTION DEVICE CONTROL INTERFACE
TO FIG. 14
TO FIG. 15
TO FIG. 16
TO FIG. 11
TO FIG. 10
TO FIG. 9
AMP
AND
OR
X-OR
FLIP FLOP
LED
GAS ON
FUEL SELECTION
NC LOW
FUEL FLOW
NO LOW
NO HIGH
NC HIGH

AUTOMATIC COMBUSTION CONTROL METHOD AND APPARATUS

FIELD OF THE INVENTION

This invention relates to an automatic combustion control method and apparatus for controlling the combustion of a fossil fuel, such as gas or oil, for example, in a combustion system, such as a furnace or boiler, for example.

BACKGROUND OF THE INVENTION

This invention relates to the control of combustion in a combustion system of the type comprising a combustion chamber, combustion means for causing the combustion of fuel in such chamber, a heat exchanger connecting with the combustion chamber for deriving useful heat from the combustion therein, an exhaust passage for removing the waste products of the combustion, fuel supply means for supplying fuel to the combustion means, and air supply means for supplying air to support the combustion.

OBJECTS OF THE INVENTION

One object of the present invention is to provide a new and improved combustion control method and apparatus for regulating the supply of air so as to maximize the combustion efficiency.

A further object is to provide a new and improved combustion system in which water is mixed with the air so as to increase the combustion efficiency while also controlling the deposition of combustion byproduct contaminants in the combustion system.

SUMMARY OF THE INVENTION

To accomplish these and other objects, the present invention preferably provides a method of combustion control in a combustion system comprising a combustion chamber, cumbustion means for causing the combustion of fuel in such chamber, a heat exchanger connecting with the combustion chamber, an exhaust passage connected with the heat exchanger, and fuel supply means for supplying fuel to the combustion means, such method comprising measuring the combustion temperature in the combustion chamber and producing a first quantity corresponding in magnitude with the combustion temperature, measuring the exhaust temperature in the exhaust passage and producing a second quantity corresponding in magnitude with the exhaust temperature, producing a summation of the first and second quantities and thereby producing a summation quantity, and varying the supply of air to the combustion means in such manner as to maximize the summation quantity, whereby the combustion efficiency is also maximized.

The apparatus of the present invention preferably comprises variable air supply means for supplying a variable amount of air to the combustion means for supporting the combustion of the fuel therein, combustion temperature measuring means for measuring the combustion temperature in the combustion chamber and for producing a first quantity corresponding in magnitude to the combustion temperature, exhaust temperature measuring means for measuring the exhaust temperature and for producing a second quantity corresponding in magnitude to the exhaust temperature, summation means for producing a summation of the first and second quantities, and control means connected to the variable air supply means for varying the air supply to the combustion means in such manner as to maximize the summation quantity, whereby the combustion efficiency is maximized.

The combustion temperature measuring means and the exhaust temperature measuring means may take the form of thermocouples for producing voltages which are supplied to the summation means to produce a summation voltage.

The variable air supply means may take the form of a variable air valve which is operated by power control means in such manner as to maximize the summation voltage.

A minor amount of water is mixed with the air in the form of very small water droplets, 100 microns or less in size, to increase the combustion efficiency while controlling the deposition of combustion by-product contaminants in the combustion system.

The variable air supply means may comprise a variable air valve having a motor for opening and closing the valve to increase or decrease the combustion air supply.

The summation quantity can be maximized by sampling the summation quantity at periodic intervals, storing each sample summation quantity to provide a reference quantiy, and comparing each successive sample summation quantity with the previous reference quantity to determine whether the summation quantity has increased or decreased. During each interval between samples, the air valve motor may be operated in one direction or the other for a brief interval to open or close the air valve by a small amount. If the summation quantity is increased during any interval between samples, the air valve is driven in the same direction during the next interval. If the summation quantity decreases during any interval between samples, the air valve is driven in the opposite direction during the next interval.

Each sample summation quantity may be stored digitally in digital storage means, which may be updated for each sample. The stored sample becomes the reference quantity for the next sample and may be converted into analog form for comparison with the summation quantity.

Further objects, advantages and features of the present invention will appear from the following description, taken with the accompanying drawings, in which.

Figure 1:
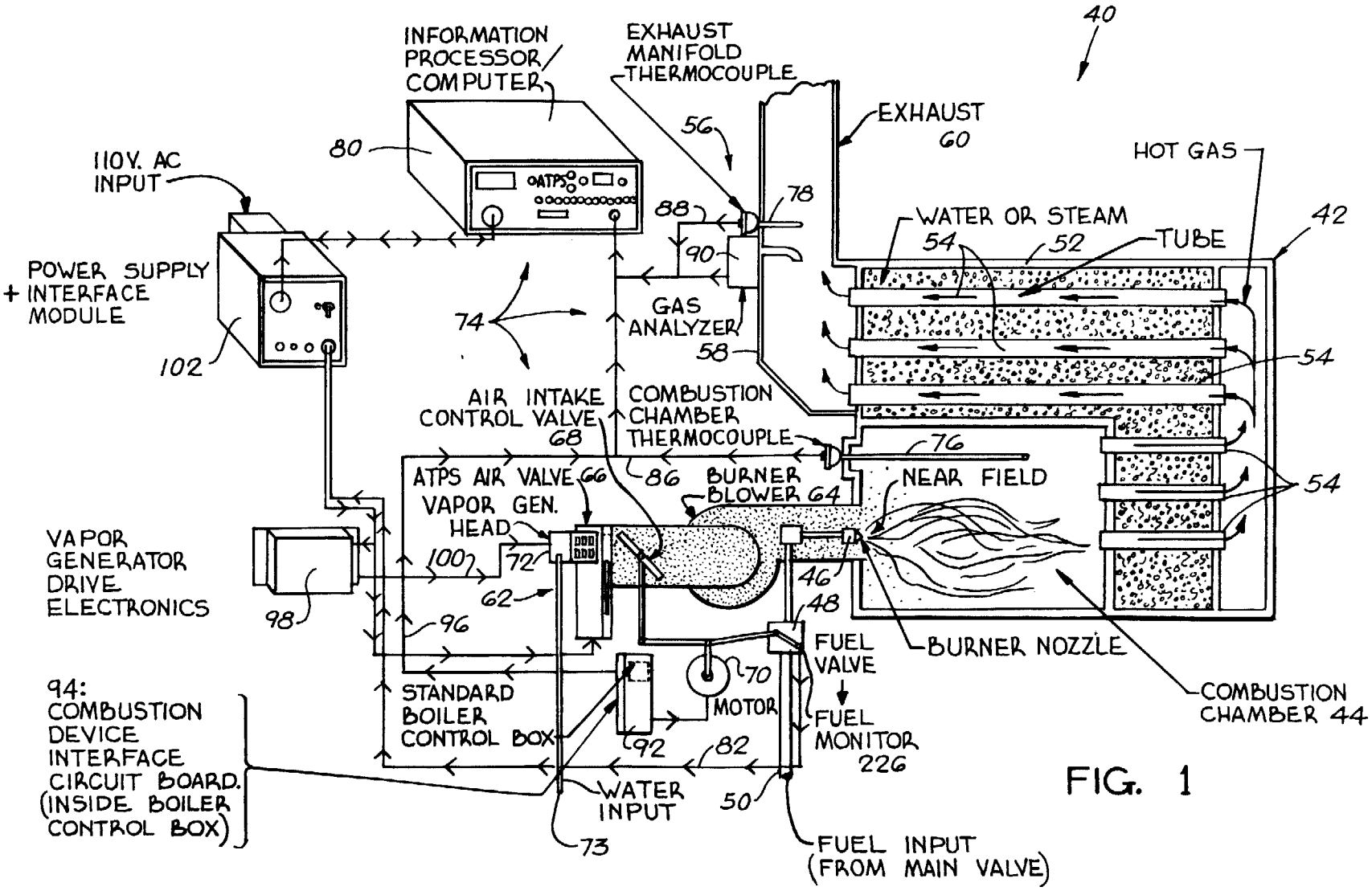
FIG. 1 is a digrammatic view, partly in section, of a combustion system to be described as an illustrative embodiment of the present invention, such combustion system being in the form of an oil fired furnace boiler.

As just indicated, FIG. 1 illustrates the present invention as embodied in a combustion system 40, including a combustion device 42 in the form of a furnace, illustrated as a furnace boiler adapted to produce hot water or steam for heating or other purposes. The furnace 42 includes a combustion chamber 44 in which a fossil fuel is burned. Such fossil fuel may be oil, for example. Thus, the furnace 42 includes combustion means in the form of a burner 46, supplied with fuel through a fuel valve 48 connected between the burner and a fuel supply pipe 50.

The furnace 42 includes a heat exchanger in the form of a boiler 52, whereby useful heat is derived from the furnace. The hot gases, representing the products of the combustion in the combustion chamber 44, pass through tubes 54 extending through the boiler 52 so that the water or steam in the boiler is heated by the hot gases. The waste gases or products of combustion from the heat exchanger tubes 54 are then removed by exhaust means 56, comprising an exhaust manifold 58 connecting with an exhaust passage or flue 60.

Air to support the combustion in the combustion chamber is provided by air supply means 62, illustrated as comprising a blower 64, to produce a forced draft of air which is mixed with the fuel as it is injected into the combustion chamber 44 by the burner 46. The amount of air supplied to the combustion chamber 44 is regulated by variable air supply means in the form of a variable air valve 66, adapted to regulate the amount of air which is supplied to the intake of the blower 64. The air valve 66 is power operated and is controlled in such a way as to maximize the combustion efficiency in the furnace 42.

For startup purposes, another variable air intake valve 68 is provided in the air intake to the blower 64. The valve 68 is operated by a motor 70 which also operates the fuel valve 48.

To improve the combustion efficiency, water is supplied to the combustion chamber 44 by a power operated vapor generator 72 which supplies water to the air intake of the blower 64, the water being supplied in the form of a mist comprising very small droplets of water. The water droplets are mixed with the air supplied to the burner 46. A water supply pipe 73 is connected to the vapor generator 72.

The heat output and the efficiency of the furnace 42 are maximized by providing an automatic control system 74 which regulates the air valve 66. Such automatic control system will be referred to in some cases as the automatic thermocontrol processor system (ATPS).

The automatic control system 74 includes combustion temperature measuring means for measuring the combustion temperature in the combustion chamber 44, such measuring means being shown as a combustion chamber thermocouple 76, adapted to produce a voltage corresponding with the combustion temperature. Such voltage constitutes a quantity or signal representing the combustion temperature.

The automatic control system 74 also includes exhaust temperature measuring means, illustrated in this case as an exhaust manifold thermocouple 78, adapted to produce a voltage corresponding with the exhaust temperature. Such voltage constitutes a quantity or signal representing the exhaust temperature.

The voltages or signals produced by the thermocouples 76 and 78 are supplied to an information processing module or computer 80 which produces a summation of the signals or quantities, and controls the automatic air valve 66 in such a manner as to maximize such summation. It has been found that maximizing the summation will also maximize the combustion efficiency and the useful heat output of the furnace 42.

For monitoring purposes, the processor or computer 80 may also be supplied with a signal indicating the setting of the fuel valve 48, such signal being transmitted along a signal line 82. Signal lines 86 and 88 are provided from the thermocouples 76 and 78 to the processor 80. A gas analyzer 90 may be connected to the processor 80, to monitor the composition of the waste gases in the exhaust manifold 58. For example, the gas analyzer 90 may monitor such factors as carbon monoxide and carbon dioxide.

The starting and cycling of the burner 46 are controlled by a standard boiler control box 92, which may operate under the control of one or more room thermostats. An interface module or circuit board 94 may be mounted within the control box 92 to provide interfacing control signals which are transmitted to the processor or computer 80 along a signal line or cable 96.

In this case, the vapor generator 72 produces ultrasonic vibrations to break up the water into very small droplets. The vapor generator 72 is supplied with power at ultrasonic frequencies by an electronic drive module 98, connected to the vapor generator 72 by a cable 100. Electrical power for the module 98, and also for the processor or computer 80, is provided by a power supply 102, which also provides an interface between the processor 80 and the electronic drive module 98, and also between the processor 80 and the fuel control valve 48. In addition, the power supply module 102 provides an interface between the processor 80 and the automatic air valve 66.

Figure 2:
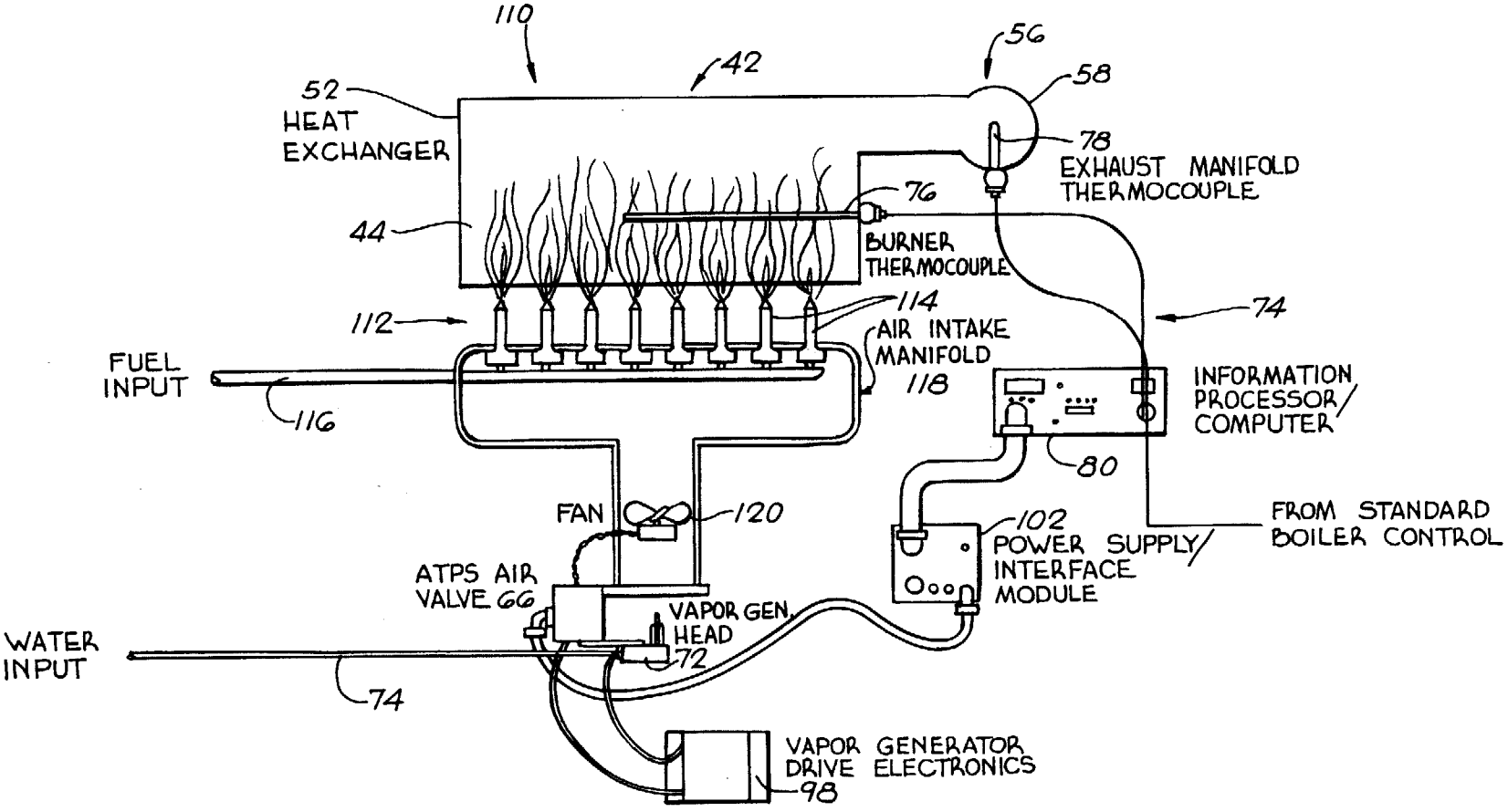
FIG. 2 is a diagrammatic view, partly in section, of a different combustion system, in the form of a gas fired furnace, constituting another embodiment of the present invention.

FIG. 2 illustrates a combustion system 110 which is somewhat different from the combustion system 40 of FIG. 1, in that the combustion system 110 employes gas burning combustion means, 112, rather than the oil burning combustion means 46 of FIG. 1. The combustion means 112 may take the form of a gas burner assembly, comprising a plurality of gas burners 114, supplied with fuel by a gas supply pipe 116. In the combustion system 110, the furnace 42, the combustion chamber 44, the heat exchanger 52 and the exhaust means 56 may be the same as described in connection with FIG. 1.

Cumbustion air is supplied to the gas burners 114 by an air intake manifold 118. A fan 120 is provided in the manifold 118 to draw air into the manifold and to propel the air to the burners 114. The air enters the manifold 118 through the automatic air control valve 66, which may be the same as described in connection with FIG. 1. The other components illustrated in FIG. 2 may also be the same as described in connection with FIG. 1, including the combustion temperature thermocouple 76, the exhaust temperature thermocouple 78, the information processor or computer 80, the water vapor generator or delivery head 72, the vapor generator drive electronics 98, and the power supply and interface module 102. FIG. 2 illustrates the fact that the present invention is fully applicable to combustion systems for burning all types of fuels, including gas, oil and other fossil fuels.

Figure 3:
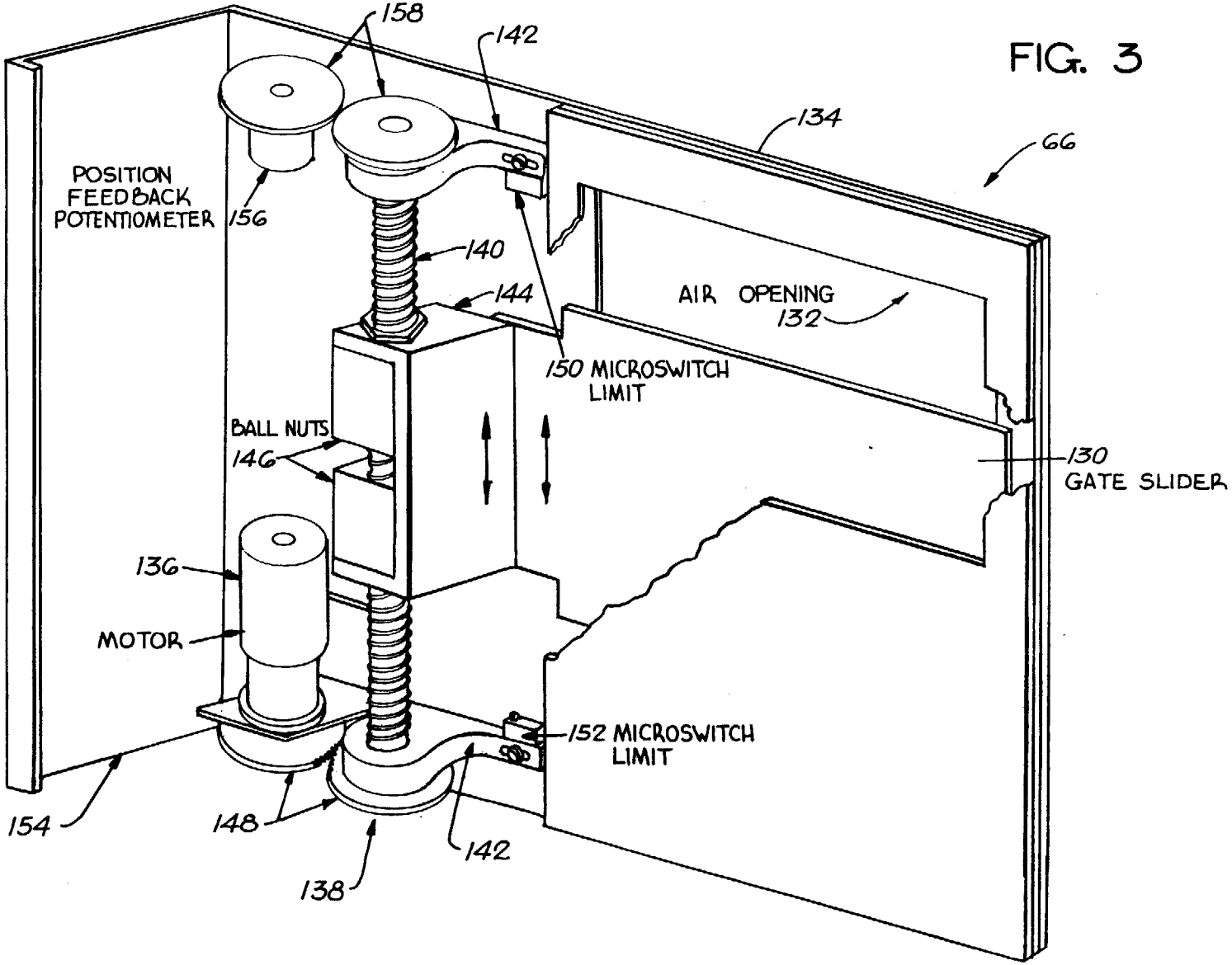
FIG. 3 is a diagrammatic perspective view of a power operated, variable air valve which may be employed in the embodiments of FIGS. 1 and 2.

FIG. 3 illustrates additional details of the power operated air valve 66 which is employed to vary the supply of combustion air to the combustion chamber 44 of FIGS. 1 and 2. In the construction of FIG. 3, the air valve 66 comprises a gate slider 130 in the form of a plate which is slidable across an air opening 132 in a mounting plate or base 134. Other suitable valve constructions may be employed. The base plate 134 is mounted across the air intake opening of the furnace 42.

The slidable gate 130 is adapted to be operated by an electric motor 136, which is connected to the gate 130 by a drive mechanism 138, illustrated as comprising a rotatable drive screw 140, rotatably supported by bearings 142. The slidable gate 130 is mounted on a travelling nut assembly 144 comprising a pair of ball nuts 46 which travel along the feed screw 140 when it is rotated. The drive screw 140 and the shaft of the electric motor 136 are geared together by a pair of meshing gears 148.

Limits which is 150 and 152 are provided to stop the motor 136 so as to limit the movement of the slidable gate 130 in its fully closed and fully opened positions, respectively. The motor 136 and the drive 138 may be enclosed within a housing 154.

It is preferred to provide feedback means to produce a signal which indicates the position of the slidable air valve gate 130, such feedback means being illustrated as a potentiometer 156 having a shaft geared to the rotatable drive screw 140 by a pair of gears 158. The potentiometer 156 provides a voltage which is varied as the air gate 130 is moved between its fully closed and fully opened positions.

Figure 4:
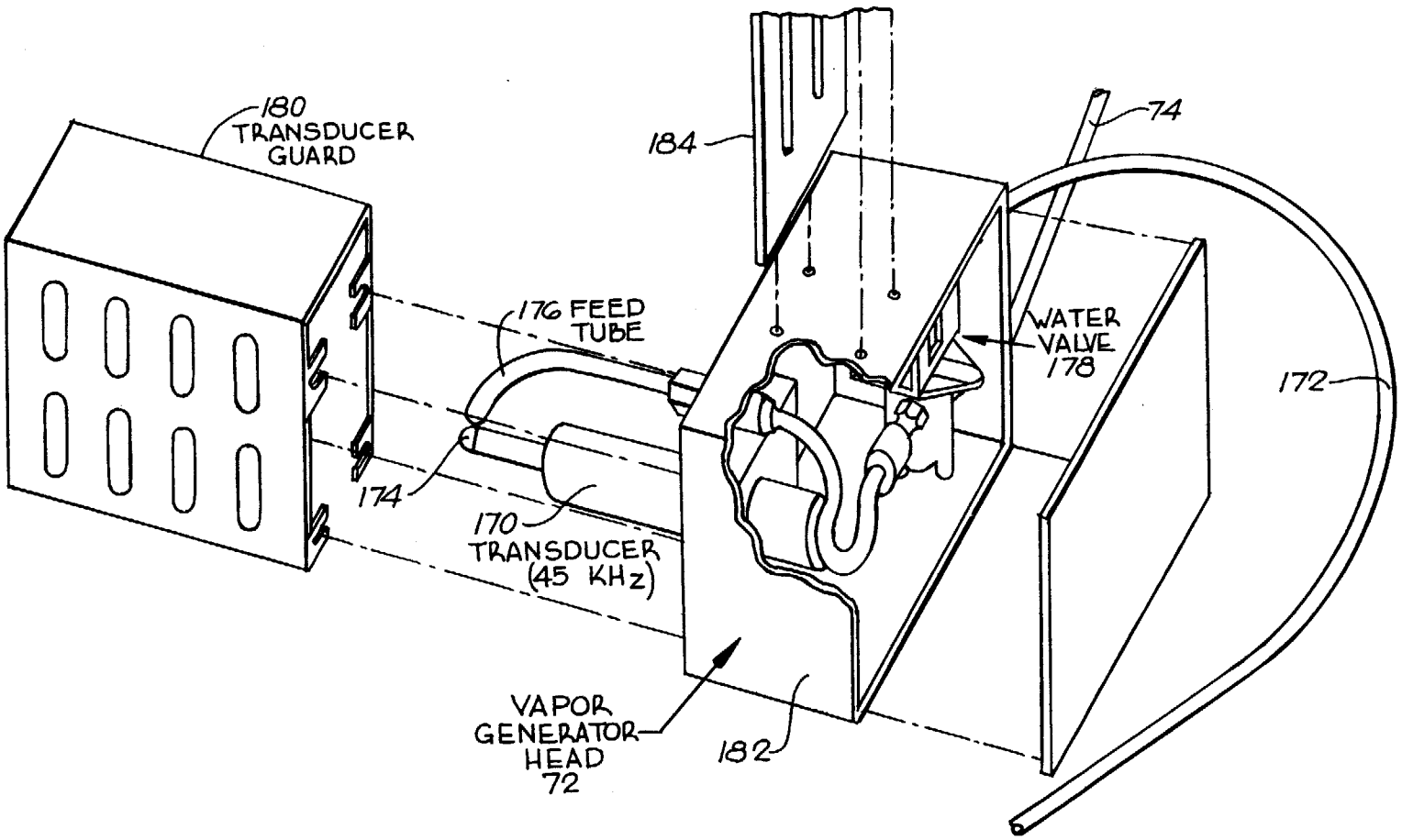
FIG. 4 is a diagrammatic perspective view of an ultrasonically powered water vapor generator employed in the embodiments of FIGS. 1 and 2.

FIG. 4 illustrates additional details of the vapor generator head 72, employed in the combustion systems of FIGS. 1 and 2 to inject a mist of very small water droplets into the combustion chamber 44, to mix with the combustion air. The vapor generator 72 employes an ultrasonic transducer 170 and may be of the construction disclosed and claimed in the applicant's U.S. Pat. No. 4,085,893, issued Apr. 23, 1978. The transducer 170 produces ultrasonic vibrations which break up the water into extremely small droplets, forming a mist or vapor. The transducer 170 may produce vibrations and a frequency of approximately 45 kHz, for example. An electrical cable 172 is employed to connect the transducer 170 to the electronic drive module 98 which supplies alternating or pulsating electrical power to the transducer at such ultrasonic frequency or some other suitable frequency. The transducer 170 translates the alternating electrical power into ultrasonic vibrations which are particularly intense at the tip portion 174 of the transducer 170. Such tip portion 174 thus functions as the vibratory member of the transducer.

Water is supplied at a controlled rate to the vibratory member 174 by a feed tube 176. A solenoid operated water valve 178 is connected between the feed tube 176 and the water supply pipe 74. The valve 178 may include means for regulating the rate at which the water is supplied to the vibratory member 174.

The water mist or vapor produced by the vapor generator head 72 is preferably supplied to the air intake of the furnace 42, so that the water mist is mixed with the combustion air. In FIG. 1, the blower 64 draws the water mist into the air intake and blows the water mist, along with the combustion air, into the combustion chamber 44. In FIG. 2, the fan 120 draws the water mist into the air intake.

As shown in FIG. 4, the transducer 170 is provided with a guard 180 which is perforated to admit air. The transducer 170 projects out of a housing 182 which is provided with a mounting bracket 184.

Figure 5:
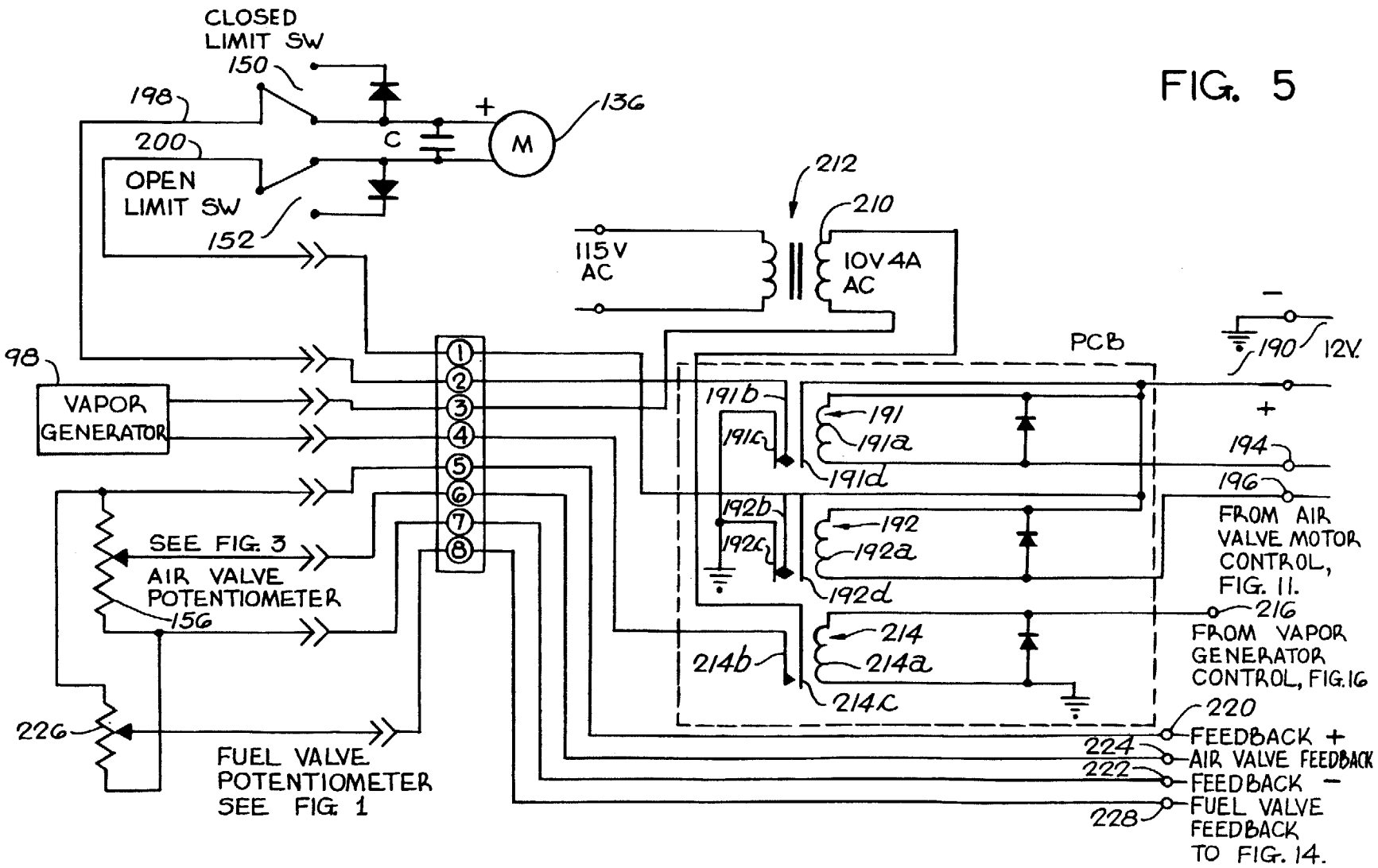
FIG. 5 is an electrical circuit diagram showing some of the circuits for controlling the operation of the variable air valve and the vapor generator for the combustion systems of FIGS. 1 and 2.

FIG. 5 illustrates electrical circuits for operating the air valve motor 146 and the electronic drive module 98 for the vapor generator head 72. The air valve motor 136 is preferably of a direct current type which is reversible in operating direction by reversing the polarity of the voltage supplied to the motor. A direct current power supply 190 may be provided to operate the motor 136, such power supply 190 providing 12 volts or some other suitable voltage. The power supply 190 may be incorporated in the power supply module 102. As shown, the −12 volt terminal is grounded. The direction of rotation of the motor 136 is controlled by two relays 191 and 192 having coils **191*a* and 192*a* which are connected between the +12 volt terminal and control terminals 194 and 196**, adapted to be energized by control circuits to be described presently.

The limit switches 150 and 152 are connected in series with leads 198 and 200, connected to the opposite sides of the motor 136. The relay 191 has a movable contact **191*b* which is movable between fixed contacts 191*c* and 191*d*. Similarly, the relay 192 has a movable contact 192*b* which is movable between fixed contacts 192*c* and 192*d*. The motor leads 198 and 200 are connected to the movable contacts 191*b* and 192*b*, which engage the contacts 191*c* and 192*c* when the relays 191 and 192 are deenergized. The contacts 191*c* and 192*c* are grounded and thus are connected to the −12 volt terminal. The contacts 190*d* and 192*d* are connected to the +12 volt terminal. When the relay 191 is energized and the relay 192 is deenergized, the motor lead 198 is connected to the +12 volt terminal, so that the motor is operated in one direction. When the relay 192 is energized and the relay 191 is deenergized, the other motor lead 200 is connected to the 12 volt terminal, so that the motor 136** is operated in the opposite direction.

The electronic drive module 98 of the vapor generator is adapted to be operated by a low voltage alternating current, derived from the secondary winding 210 of a step-down power transformer 212. The connection of the drive module 98 to the secondary winding 210 is controlled by a relay 214 having a coil **214*a* and normally open contacts 214*b* and 214*c*. The coil 214*a* is connected between ground and a control terminal 216, adapted to be energized by control circuits to be described presently. When the relay coil 214*a* is energized, the contacts 214*b* and 214*c* are closed, so as to complete the energizing circuit between the secondary winding 210 and the drive module 98** for the vapor generator.

The air valve feedback potentiometer 156 is supplied with direct current power by a feedback power supply represented by plus and minus terminals 220 and 222. The slider of the potentiometer is connected to an air valve feedback terminal 224.

A fuel valve feedback potentiometer 226 is also provided to produce a direct current signal indicating the position of the fuel valve 48. The potentiometer 226 also receives direct current power from the feedback power supply terminals 220 and 222. The slider of the fuel valve feedback potentiometer 226 is connected to a fuel valve feedback terminal 228.

Figure 6:
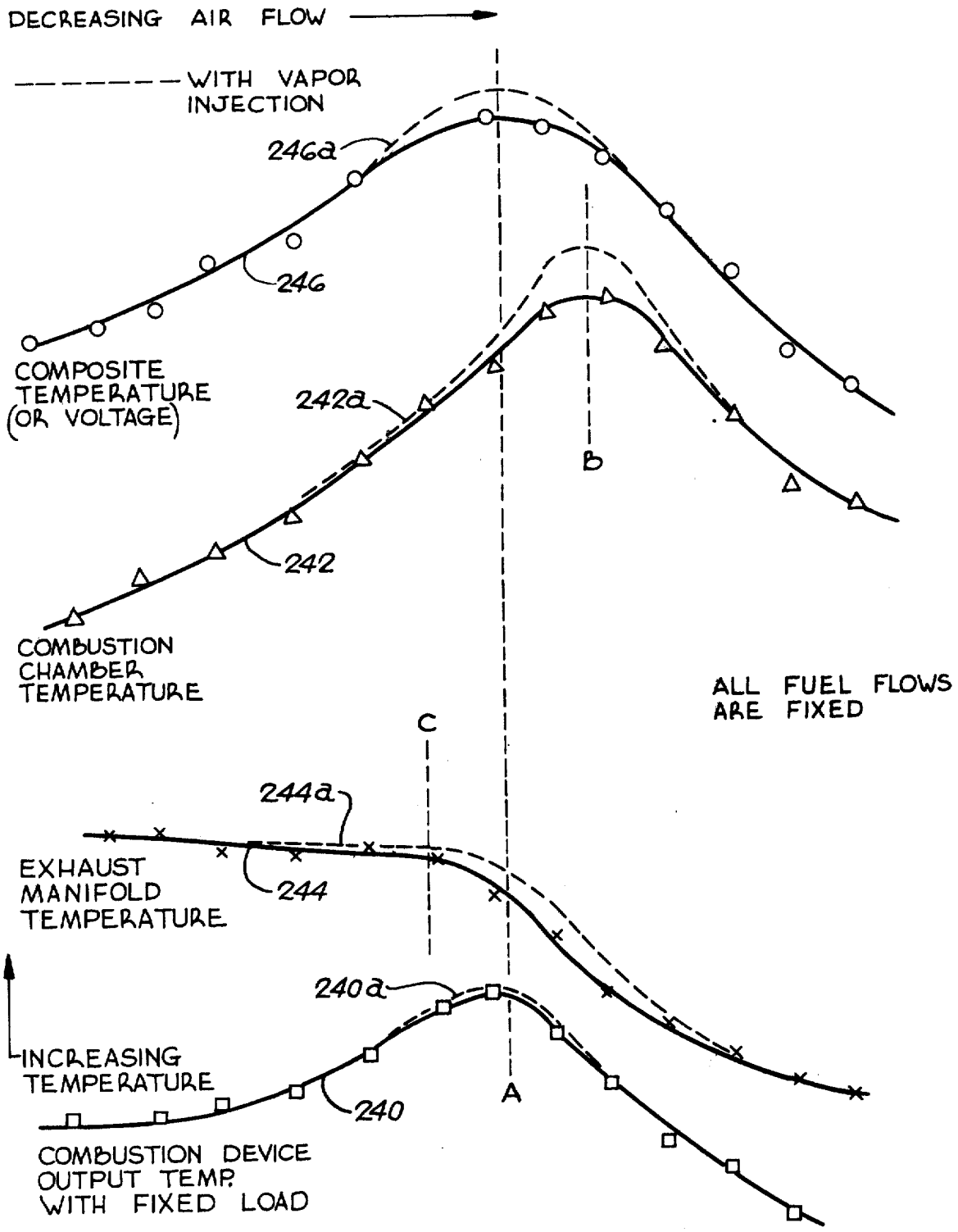
FIG. 6 is a set of graphs, illustrating the method involved in the combustion control system.

FIG. 6 is a set of graphs illustrating the operation of the automatic combustion control system of FIGS. 1 and 2. In all of the graphs, the combustion air flow is plotted along the horizontal axis. Decreasing air flow is in a right hand direction. Increasing temperature is plotted upwardly along the vertical axis.

FIG. 6 includes a graph 240 which is a plot of the combustion device output temperature with fixed load, as the combustion air flow is decreased. The graph 240 reaches a maximum or peak at an air flow value A, which represents the air flow at which the useful heat output and the combustion efficiency are maximized. When water vapor injection is employed, a graph 240*a* is obtained which is appreciably higher than the graph 240, thus demonstrating that the injection of water vapor increases the heat output and the combustion efficiency. The graph 240*a* reaches a peak at the same air flow rate A, as in the case of the graph 240. When the air flow is increased above the optimum value A, the excess air cools the combustion chamber and reduces the output temperature. When the air flow is decreased below the optimum value A, the combustion efficiency is reduced, so that the output temperature is reduced.

FIG. 6 also includes a graph 242 which is a plot of the combustion chamber temperature, or the voltage developed by the combustion temperature thermocouple 76. It has been found that the graph 242 peaks or reaches a maximum at an air flow value B which is substantially less than the optimum air flow value A. When water vapor injection is employed, a graph 242*a* is obtained which also peaks at the air flow value B, but at a significantly higher temperature, indicating that the injection of water vapor increases the combustion temperature.

FIG. 6 also includes a graph 244 which is a plot of the exhaust manifold temperature, or the voltage developed by the exhaust manifold thermocouple 78. A similar but somewhat higher graph 244*a* is obtained when water vapor is injected. As the air flow is decreased, the exhaust manifold temperature decreases gradually, and then starts to decrease more rapidly at an air flow rate C which is somewhat greater than the optimum air flow value A.

FIG. 6 includes another graph 246 which is a summation or composite of the combustion chamber temperature and the exhaust manifold temperature. The composite temperature may be a composite or summation of the voltages developed by the combustion chamber thermocouple 76 and the exhaust manifold thermocouple 78. A similar but somewhat higher graph 246*a* is obtained when water vapor injection is employed. It will be seen that the composite or summation temperature graph 246 reaches a peak or maximum at the optimum air flow rate A, and that the graph 246*a* reaches a maximum at the same air flow rate.

Thus, the graphs of FIG. 6 show that the useful heat output and the operating efficiency of the combustion system will be maximized if the combustion air flow rate is varied in such a manner as to maximize the summation or composite of the combustion chamber temperature and the exhaust manifold temperature. These temperatures may be easily measured by the combustion chamber thermocouple 76 and the exhaust manifold thermocouple 78, which will follow the combustion and exhaust temperatures on a current basis, with very little lag. The thermocouples 76 and 78 produce voltages representing the combustion and exhaust temperatures. A summation of these voltages is produced and is the composite quantity which is maximized by varying the air flow rate. It will be understood that the air flow rate is varied by adjusting the power operated air valve 66.

Figure 7:
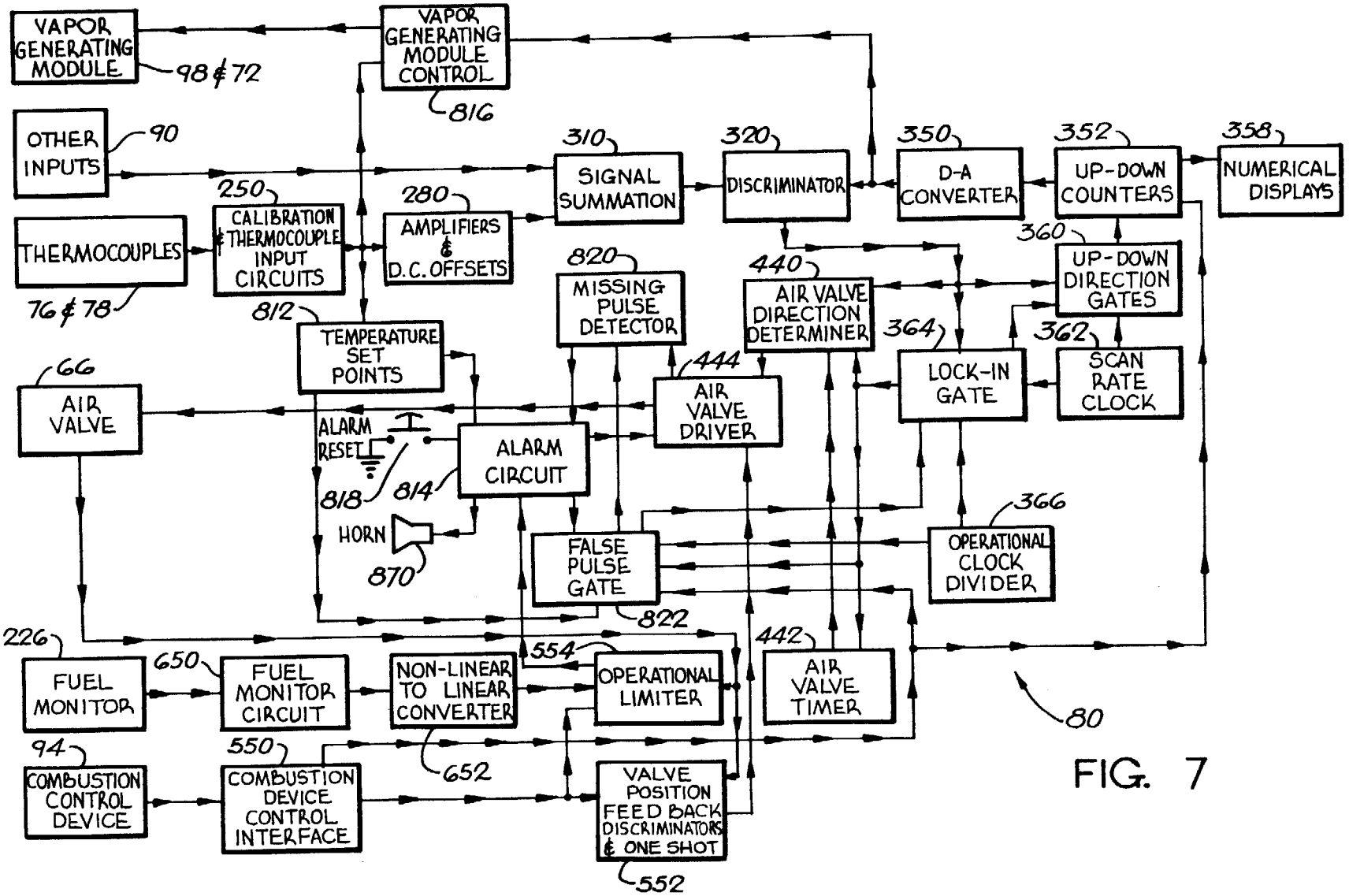
FIG. 7 is a block diagram illustrating the electronic circuit components employed in the combustion control system.

FIG. 7 and the Figures which follow illustrate additional details of the information processor or computer 80, employed in the combustion systems of FIGS. 1 and 2. It will be understood that a general purpose computer, such as a microprocessor, can be programmed to perform the functions of the processor 80. The various components of the processor 80 are shown and labeled in the block diagram of FIG. 7, and are shown in greater detail in the Figures which follow.

Figure 8:
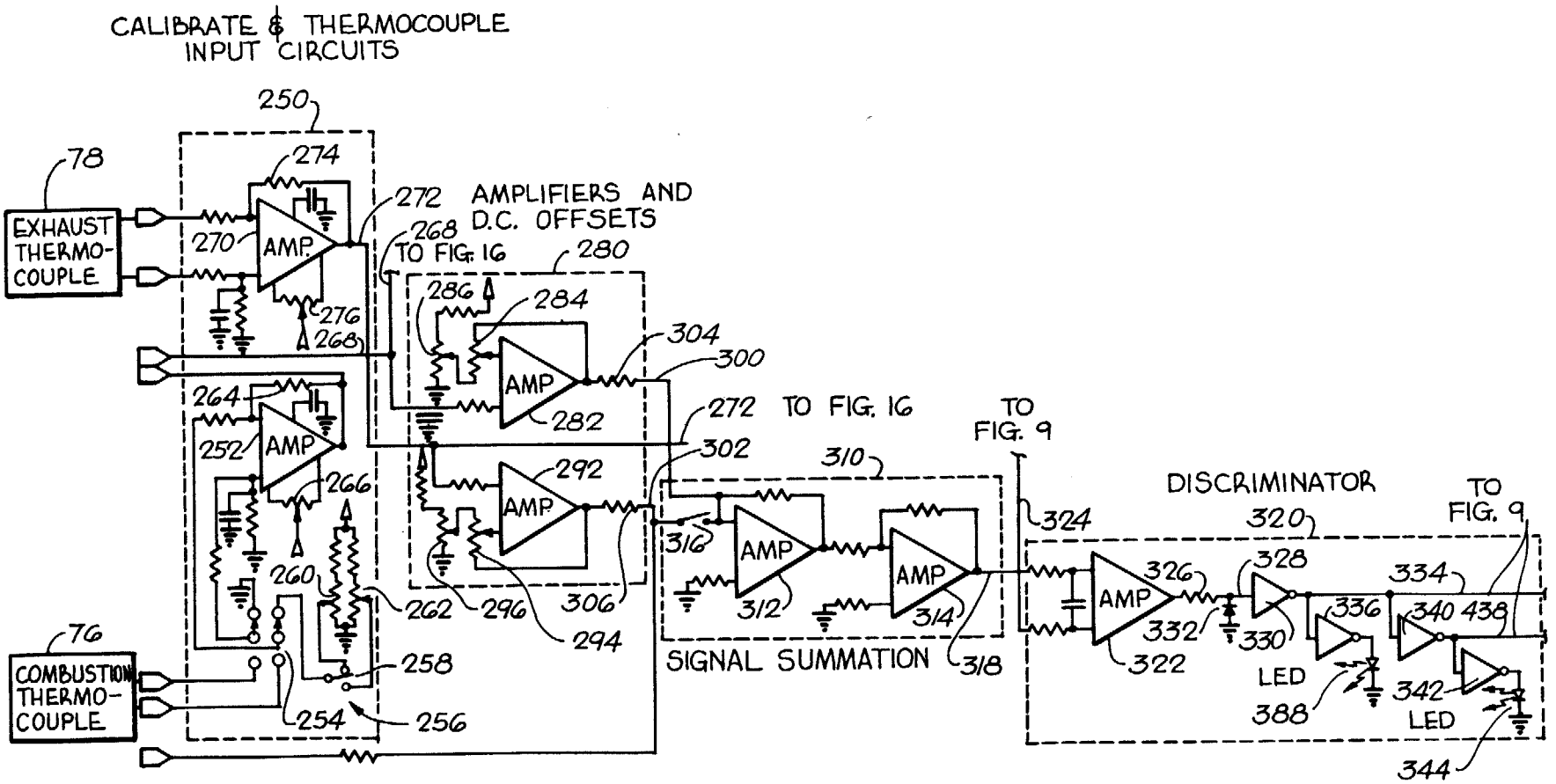
FIGS. 8–11 are schematic diagrams illustrating electronic circuits employed in the combustion control system for varying the position of the air valve.

As shown in FIGS. 7 and 8, the combustion temperature thermocouple 76 and the exhaust temperature thermocouple 78 are connected to calibration and thermocouple input circuits 250, which provide amplification of the thermocouple voltages, while also providing adjustable calibration voltages which may be switched into the circuit for calibration purposes. Thus, the input circuit 250 includes an operational amplifier 252, having its inputs connected to the combustion thermocouple 76, through a double pole, double throw calibration switch 254, whereby the inputs of the amplifier 252 can be connected to either the thermocouple 76 or a calibration voltage circuit 256. As shown, the calibration voltage circuit 256 comprises a selector switch 258 whereby either of two calibration voltages may be supplied to the amplifier 252. The two calibration voltages are provided by a low temperature calibration potentiometer 260 and a high temperature calibration potentiometer 262.

The amplifier 252 is provided with a feedback resistor 264 which affords a small amount of positive feedback, and a null balancing potentiometer 266. The output of the amplifier 252 is connected to an output lead 268.

The exhaust temperature thermocouple 78 is connected to the inputs of a second operational amplifier 270 having an output lead 272. Like the amplifier 252, the amplifier 270 is provided with a positive feedback resistor 274 and a null balancing potentiometer 276.

As shown in FIGS. 7 and 8, the output leads 268 and 272 of the input circuit 250 are connected to a circuit 280, designated AMPLIFIERS AND DC OFFSETS, which provides adjustable gain and a direct current offset adjustment for each of the thermocouple channels. Thus, the output lead 268, which carries the combustion thermocouple signal, is connected to one input of an operational amplifier 282, the other input of which is provided with a gain adjusting potentiometer 284 and a DC offset adjusting potentiometer 286. Similarly, the lead 272, which carries the exhaust thermocouple signal, is connected to one input of an operational amplifier 292, the other input of which is connected to a gain adjusting potentiometer 294 and a DC offset adjusting potentiometer 296. The outputs of the amplifiers 282 and 292 are connected to output leads 300 and 302 through coupling resistors 304 and 306.

The amplifiers 282 and 292 provide additional gain for the combustion and exhaust thermocouple voltages, such gain being adjustable in each case so that the output voltages of the amplifiers accurately represent the combustion and exhaust temperatures. The DC offset adjustments make it possible to eliminate direct current offsets from the output voltages.

The output leads 300 and 302 from the circuit 280 are connected to a circuit 310 which is designated SIGNAL SUMMATION. The circuit 310 effectively adds the combustion and exhaust temperature signals together and produces an output summation signal which represents the summation of the combustion and exhaust temperatures, in terms of voltage.

As shown in FIG. 8, the summation circuit 310 includes two successive operational amplifiers 312 and 314, having negative feedback so that each amplifier has unity gain. The second amplifier 214 is simply a phase inverter, to overcome the phase inversion produced by the first amplifier 312, so that the summation circuit 310 as a whole does not produce phase inversion. The lead 300, which carries the combustion temperature signal, is connected directly to the inverting input of the amplifier 312. The lead 302, which carries the exhaust temperature signal, is connected to the inverting input of the amplifier 312 through a switch 316, whereby the exhaust thermocouple signal can be disconnected for purposes of calibration and adjustment. When the switch 316 is closed, the combustion temperature signal, carried by the lead 300, and the exhaust temperature signal, carried by the lead 302, are arithmetically added at the inverting input of the amplifier 312. A corresponding summation output signal appears on the output lead 318 from the amplifier 314. This summation output signal or voltage represents the summation or composite of the combustion temperature and the exhaust temperature which is to be maximized by the control system. The coupling resistors 304 and 306 participate in the arithmetic summation of the combustion and exhaust thermocouple signals.

At the output of the summation circuit 310, the output lead 318, which carries the summation temperature signal, representing the composite of the combustion temperature and the exhaust temperature, is connected to a circuit 320, designated DISCRIMINATOR, which determines whether the summation temperature signal is increasing or decreasing. This may be done by comparing the summation temperature signal with a variable reference signal or voltage. Thus, the discriminator circuit 320 comprises an operational amplifier 322 which is employed as a comparator. The output lead 318, which carries the summation temperature signal, is connected to one input of the comparator amplifier 322. The other input is connected to a lead 324 which is supplied with a variable reference voltage, in a manner to be described presently. The output of the comparator amplifier 324 is applied to a resistor 326 to the input lead 328 of a Schmitt trigger 330 which is employed as a phase inverter. A clamping diode 332 is connected between the input lead and ground, so that the signals on the input lead 328 will be unidirectional. The output of the Schmitt trigger 330 is connected to an output lead 334 which carries unidirectional output signals constituting ones and zeros, indicating whether the summation temperature signal on the line 318 is greater or less than the reference voltage on the line 324.

The discriminator circuit 320 also includes visual indicators, to show the state of the signals on the output line 334. Thus, the output line 334 is connected to the input of a first LED driver Schmitt trigger 336 having its output connected to a first LED 338, which may be lighted when the signal on the output line 334 is zero. A phase inverter Schmitt trigger 340 and a second LED driver Schmitt trigger 342 are connected between the output line 334 and a second LED 344, which may be lighted when the signal on the line 334 is A 1.

Figure 9:
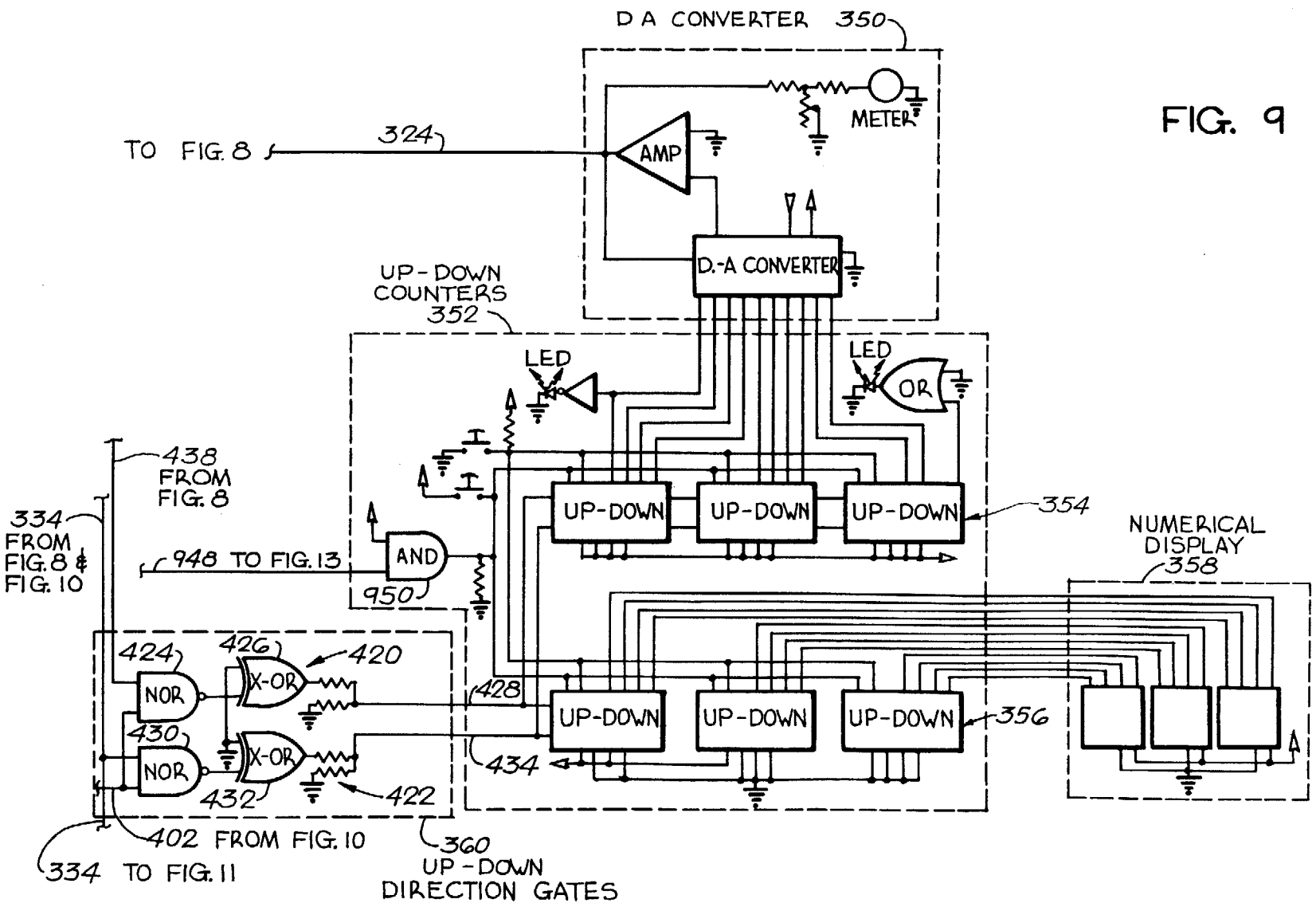
Figure 10:
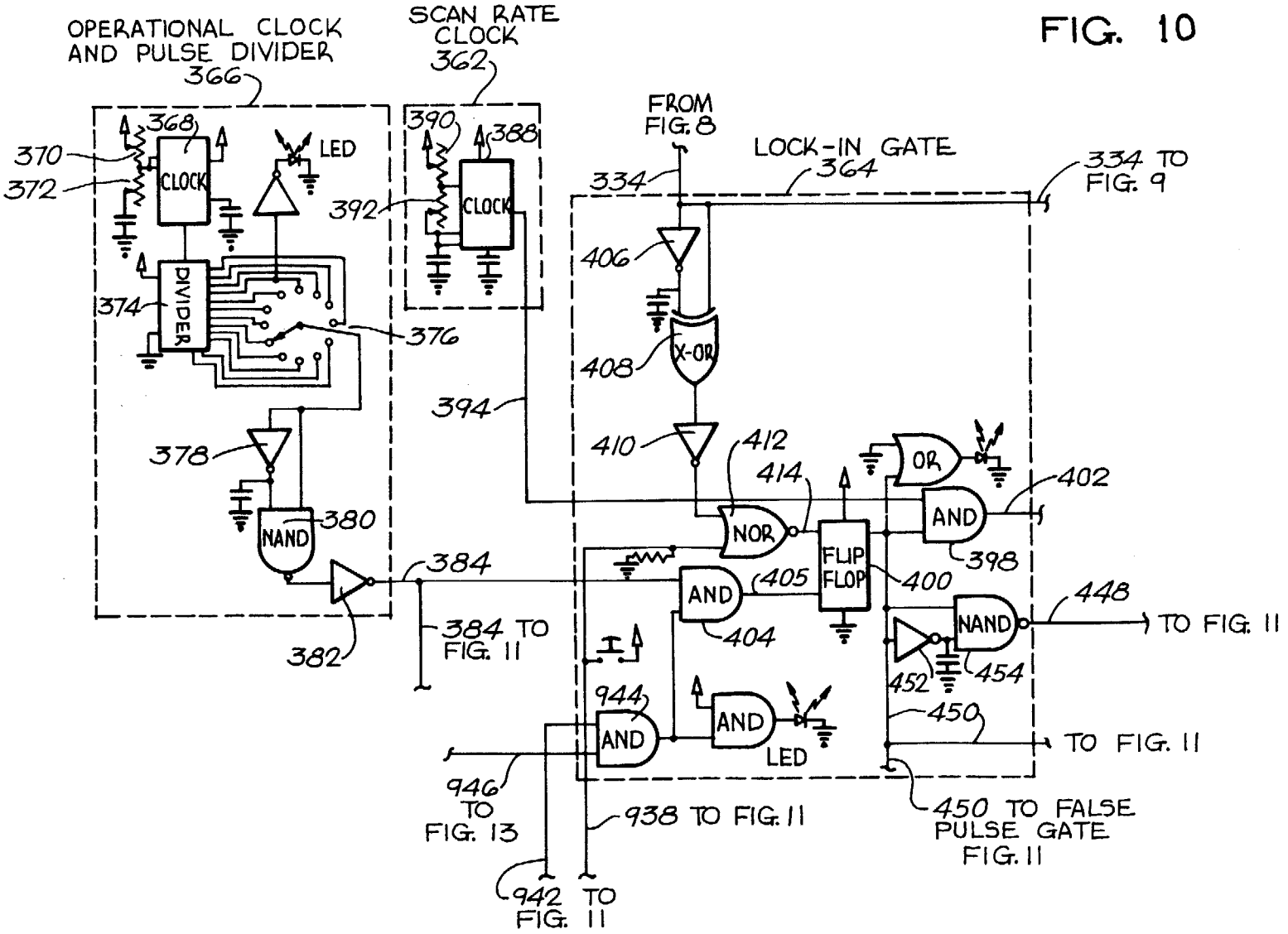

The variable reference voltage, to be supplied to the second input line 324 of the discriminator 320, is produced by the circuits of FIGS. 9 and 10. Thus, the reference voltage line 324 is connected to the analog output of a circuit 350, designated D-A CONVERTER, which converts a digital number or function into an analog voltage, serving as the reference voltage. The digital number or function is variable up and down and is produced by a circuit 352, designated UP-DOWN COUNTERS, having a binary section 354 and a decimal section 356 which are connected in parallel. The outputs of the binary counter section 354 are connected to the digital inputs of the D-A CONVERTER circuit 350. The outputs of the decimal countersection 356 are connected to a decimal display circuit 358, designated NUMERICAL DISPLAY, which displays a number representing the composite or summation temperature of the combustion temperature and the exhaust temperature.

Pulses to step the UP-DOWN COUNTER 352 are supplied to the counter through a circuit 360, designated UP-DOWN DIRECTION GATES, shown in FIG. 9. Such pulses are derived from a circuit 362, designated SCAN RATE CLOCK, and are supplied to the circuit 360 through a circuit 364, designated LOCK-IN GATE. The circuits 362 and 364 are shown in FIG. 10. Control pulses are supplied to the LOCK-in GATE 364 by a circuit 366, designated OPERATIONAL CLOCK AND DIVIDER.

The Operational Clock circuit 366 develops a continuous chain of positive clock pulses and acts as the heartbeat of the control system. Thus, the clock circuit 366 comprises a basic clock module 368 having potentiometers 370 and 372 for adjusting the frequency and the duty cycle of the clock pulses. The output pulses from the clock module 368 are supplied to a divider module 374, provided with a multi-positioned switch 376 for changing the denominator which is involved in the division of the pulse rate by the divider 374. The divider module 374 produces accurately spaced pulses at a slower rate which can be varied by operating the denominator switch 376. The denominator is varied according to the thermal inertia within the combustion device or furnace 42. The pulses from the selector switch 376 are transmitted through an inverter 378, a NAND Gate 380 and another inverter 382 to an output line 384 which extends to the lock-in gate circuit 364.

The scan rate clock circuit 362 of FIG. 10 is an independent pulse generating circuit with a frequency which determines the scan rate of the UP-DOWN COUNTER 352 and the D-A CONVERTER 350. As shown in FIG. 10, the circuit 362 comprises a clock module 388 having potentiometers 390 and 392 for adjusting the pulse rate and the duty cycle of the clock pulses, which are supplied to an output line 394, extending to the LOCK-IN GATE 364, the open or closed condition of the gate 364 depends upon the operational clock pulses, supplied along the line 384 from the operational pulse generator 366, and the output signals from the discriminator 320, supplied along the line 334. The line 394, which carries the scan rate pulses, is connected to one input of an AND gate 398, the other input of which is connected to the output of a flipflop 400. The output of the AND gate 398 is connected to a lead 402 which extends to the pulse input of the UP-DOWN directional gate circuit 360 of FIG. 9. When the gate circuit 364 is open, the AND gate 398 transmits the scan-rate pulses to the directional gate 360, which transmits them to either the up or the down input of the UP-DOWN counter 352.

The operational clock pulses, supplied by the line 384, tend to open the gate 364. Thus, the line 384 is connected to one input of an AND gate 404, the output of which is connected to one input 405 of the flipflop 400.

When the discriminator 320 determines that the summation temperature voltage on the line 318 is the same as the reference voltage on the line 324, the discriminator 320 supplies an output signal on the line 334 which closes the lock-in gate 364. It will be seen from FIG. 10 that the line 334 is connected through an inverter amplifier 406, an exclusive OR gate 408, and another inverter 410 to one input of an OR gate 412, the output of which is connected to the other input 414 of the flipflop 400. A signal at this input causes the flipflop 400 to close the AND gate 398. When a signal is absent at the input 414, the operational pulses at the input 405 cause the flipflop 400 to open the AND gate 398, so that the scan-rate pulses are transmitted between the line 394 and the line 402, to the UP-DOWN counter directional gate 360 of FIG. 9.

Such directional gate 360 comprises an UP channel 420 and a DOWN channel 422 which are opened alternatively. The UP channel 420 comprises a NOR gate 424 having its output connected to one input of an exclusive OR gate 426, the output of which is connected to the UP input 428 of the UP-DOWN counter 352. Similarly, the DOWN channel 422 comprises a NOR gate 430 having its output connected to one input of an exclusive OR gate 432, the output of which is connected to the DOWN input 434 of the UP-DOWN counter 352. The pulse output line 402 of the LOCK-IN gate 364 is connected to one input of each of the NOR gates 424 and 430, which are opened alternatively by signals applied to their other inputs. Thus, the other input of the DOWN NOR gate 430 is connected to the output line 334 from the discriminator circuit 320 of FIG. 8. The other input of the UP NOR gate 424 is connected to a line 438 which extends to the output of the inverter 340 in the discriminator circuit 320 of FIG. 8. Thus, the lines 334 and 338 carry relatively inverted or complimentary signals from the output of the discriminator circuit 320, so that the NOR gates 424 and 430 are opened alternatively. Thus, the UP-DOWN counter 352 is counting UP when the summation temperature voltage on the line 318 exceeds the reference voltage on the line 324. In this way, the D-A converter 350 raises the reference voltage to match the summation temperature voltage. When the summation temperature voltage is less than the reference voltage, the UP-DOWN counter 352 is counting DOWN, so that the D-A converter 350 lowers the reference voltage to match the summation temperature voltage.

The operation of the counter 352 takes place when the LOCK-IN gate 364 is opened by the operational pulses from the clock circuit 366. The gate 364 is also closed when the discriminator circuit 320 determines that the summation temperature voltage and the reference voltage are equal.

Figure 11:
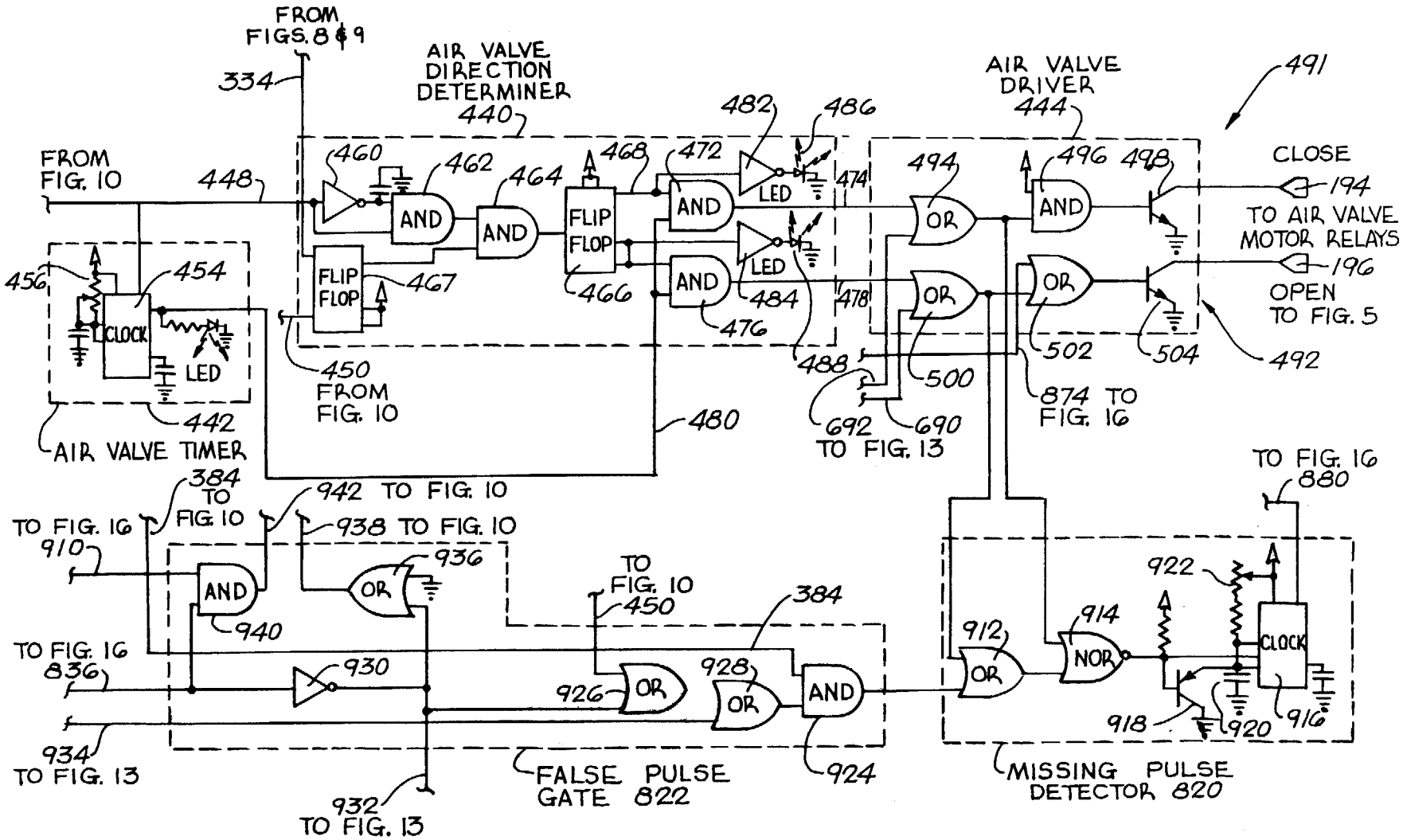

FIG. 11 illustrates detailed electronic circuits for controlling the operation of the air valve motor 136, so as to open or close the air valve 66, as needed, to maximize the summation voltage, representing the summation of the combustion temperature and the exhaust temperature. More specifically, FIG. 11 illustrates an electronic circuit 440, designated AIR VALVE DIRECTION DETERMINER; a circuit 442, designated AIR VALVE TIMER; and a circuit 444, designated AIR VALVE DRIVER.

The Air Valve Direction Determiner circuit 440 is controlled by two inputs, comprising the operational pulses from the operational clock and pulse divider circuit 366, as transmitted through the LOCK-IN gate circuit 364 of FIG. 10; and the signals from the discriminator circuit 320 of FIG. 8. The Direction Determiner circuit 440 determines electronically whether the air valve 66 should be driven open or closed. When the output of the discriminator circuit 320 is positive, corresponding to an increase in the temperature summation voltage, as produced by the summation circuit 310, the air valve 66 is driven either open or closed, but in the same direction as the valve was driven during the previous instance. When the signal from the discriminator circuit 320 is negative, corresponding to a decrease in the temperature summation voltage, the air valve 66 is driven either open or closed, but in the opposite direction, relative to the direction during the previous instance. The air valve 66 is driven in one of these two ways by every operational pulse from the operational clock and pulse divider circuit 366.

The air valve timer circuit 442 produces a timing pulse, the length of which determines the time during which the air valve motor 136 is operated for each cycle. Thus, the length of this timing pulse determines the distance through which the air valve 66 travels for each operational pulse from the operational clock and pulse divider circuit 366.

The air valve driver circuit 444 energizes one of the air valve motor relays 191 and 192, so that the air valve motor 136 is operated in one direction or the other, so as to close or open the air valve 66. The air valve driver circuit 444 is controlled by pulses from the direction determiner circuit 440.

The operational clock pulses from the clock and divider circuit 366 are supplied to the direction determiner circuit 440 through the LOCK-IN gate circuit 364. Thus, the circuit 440 of FIG. 11 has an input line 448 which extends to the gate circuit 364 of FIG. 10. The circuit 440 of FIG. 11 has a second input line 450 which is connected to the output of the flipflop 400 in the gate circuit 364 of FIG. 10. In the gate circuit 364, an inverter Schmitt trigger 452 and a NAND gate 454 are connected between the output of the flipflop 400 and the lead 448, constituting the first input lead of the direction determiner circuit 440.

The first input lead 448 is also connected to the air valve timer circuit 442, to provide signals for starting the timer 442. It will be seen that the timer circuit 442 includes a clock module 454 having a potentiometer 456 for adjusting the length of the clock pulses. The input line 448 is connected to the enabling input of the clock module 454.

In the direction determiner circuit 440, an inverter Schmitt trigger 460 and an AND gate 462 are connected between the first input lead 448 and one input of an AND gate 464, the output of which is connected to the input of a flipflop 466. The second input lead 450 is connected to one input of a flipflop 467 having its output connected to the other input of the AND gate 464. The other input of the flip-flop 467 is connected to the output lead 334 of the temperature discriminator circuit 320 of FIG. 8.

The state of the flipflop 466 determines the direction of operation of the air valve motor 136. Thus, the flipflop 466 has two outputs 468 and 470 which are energized alternately, to cause the air valve 66 to be closed or opened. The output 468 is connected to one input of an AND gate 472 having its output connected to one input lead 474 of the air valve driver circuit 444. A signal on the line 474 causes the air valve motor 136 to operate in a direction such as to move the air valve 66 toward its closed position. The other output 470 of the flipflop 466 is connected to one input of an AND gate 476 having its output connected to a second input lead 478 of the driver circuit 444. A signal supplied to the lead 478 causes the air valve motor 136 to operate in a direction such as to open the air valve 66. The AND gates 472 and 476 have second inputs which are connected to a line 480 extending to the output of the clock module 454 in the timer circuit 442. Thus, the timing pulse from the clock module 454 is supplied to the gates 472 and 476, which terminate the operation of the air valve motor 136 at the end of the timing pulse. The outputs 468 and 470 are also connected through driver Schmitt triggers 482 and 484 to indicating devices in the form of LEDs 486 and 488.

The input leads 474 and 478 of the driver circuit 444 for the air valve motor 136 are connected to valve closing and valve opening channels 491 and 492. Thus, the input lead 474 is connected to one input of an OR gate 494 having its output connected to one input of an AND gate 496, the output of which is connected to the base of a transistor 498. The emitter of the transistor 498 is grounded, while the collector of the transistor is connected to the terminal 194 to which the coil of the motor relay 191 is connected. Thus, when the transistor 498 is conductive, the air valve motor 136 is operated in a direction to close the air valve 66.

The second input lead 478 of the driver circuit 444 is connected to one input of an OR gate 500 having its output connected to one input of an OR gate 502, the input of which is connected to the base of a transistor 504. The emitter of the transistor 504 is grounded, while the collector of the transistor is connected to the terminal or lead 196, to which the coil of the motor relay 192 is connected. When the transistor 504 is energized, the motor 136 is operated in a direction to open the air valve 66. The other inputs of the OR gates 494 and 500 are not normally supplied with signals, except during startup conditions. The other input of the OR gate 502 is not normally supplied with signals, except during an alarm or shutdown condition.

Each operational pulse on the line 448 starts the timer 442, which opens the AND gates 472 and 476. Either the output 468 or the output 470 of the flipflop 466 is always energized, and the energized output causes either the transistor 498 or the transistor 504 to be conductive, so as to operate the air valve motor 136 in a direction to close or open the air valve. The state of the flipflop 466 is not changed, as long as the signals on the line 334 from the temperature discriminator 320 are positive, thus indicating that the summation voltage is increasing. If the summation voltage is decreasing, the signals on the line 334 from the discriminator 320 are negative, which has the effect of passing an operational pulse to the flipflop 466, so that its state will be changed. The direction of movement of the air valve is thereby reversed.

Figure 12:
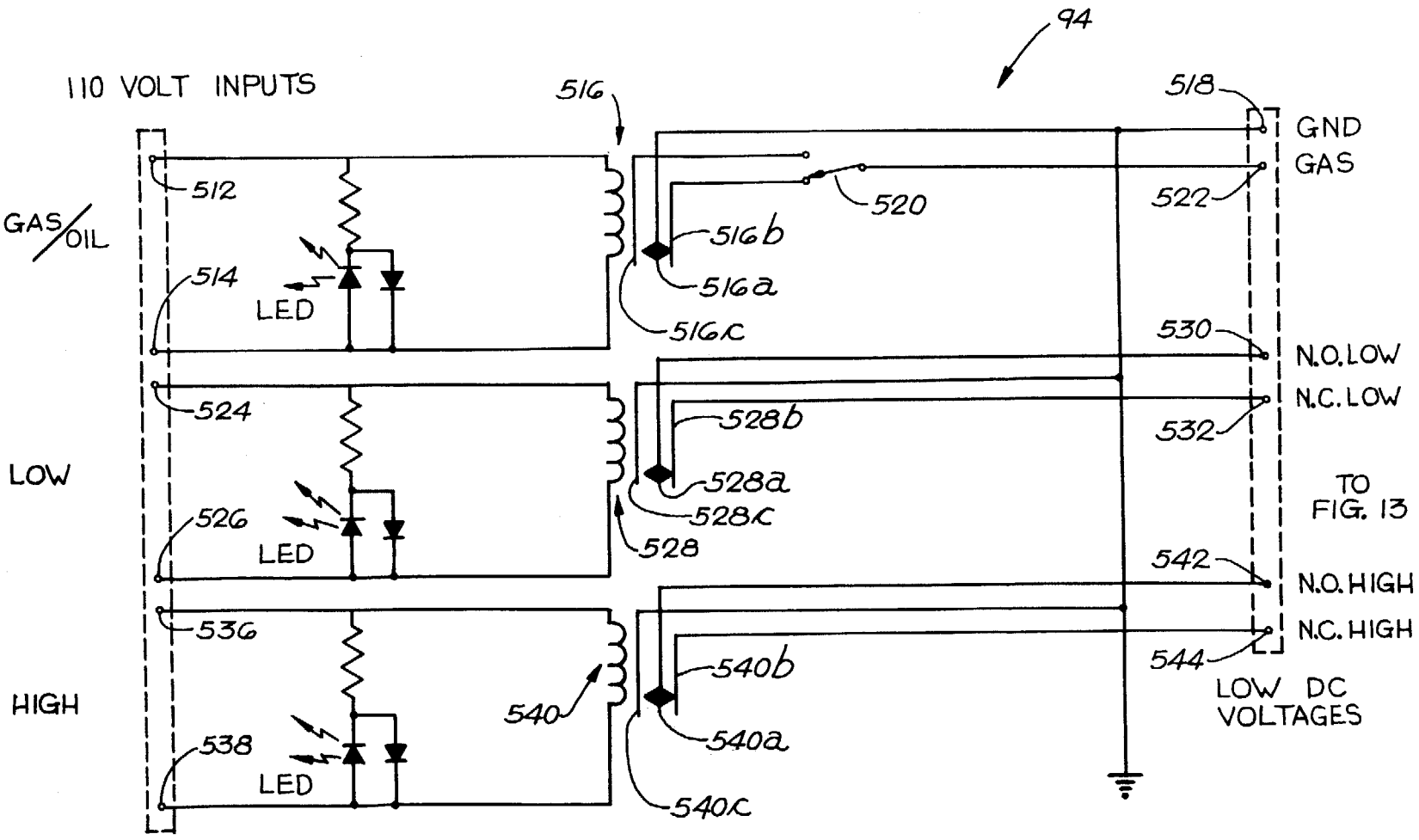
FIG. 12 is a schematic circuit diagram of an interface circuit, employed between the boiler control box and the combustion control system.

FIG. 12 illustrates the interface circuit 94 which provides an interface between the boiler control box 92 of FIG. 1 and the information processor or computer 80. The circuit 94 provides an interface between the 110 volt A.C. control components in the boiler control box 92 and the low voltage direct current electronic circuits of the processor 80. The boiler control box 92 may include fuel switching means for switching between oil and gas. The circuit 94 includes terminals or leads 512 and 514 which are energized or deenergized, according to whether gas or oil is selected as the fuel. The terminals 512 and 514 are connected to the coil of a relay 516 having a movable contact **516*a* which is movable between fixed contacts 516*b* and 516*c* when the relay is energized. The movable contact 516*a* is connected to ground and to a grounded terminal 518. The contacts 516*b* and 516*c* are connected to a selector switch 520, whereby either of the contacts 516*b* and 516*c* may be connected to a terminal or lead 522**, designated GAS.

When oil is being used as the fuel, and when the boiler control box 92 is calling for a low fuel rate, the control box 92 energizes a pair of terminals 524 and 526 which are connected to the coil of a relay 528, whereby a movable contact **528*a* is moved between fixed contacts 528*b* and 528*c*. The movable contact 528*a* is connected to ground, while the contacts 528*b* and 528*c* are connected to terminals or leads 530 and 532**, designated N.O. LOW and N.C. LOW, where N.O. means "normally open", while N.C. means "normally closed".

When oil is the fuel, and the boiler control box 92 is calling for a high fuel rate, the control box 92 energizes a pair of terminals 536 and 538, connected to a relay coil 540, whereby a movable contact **540*a* is movable between fixed contacts 540*b* and 540*c*. The movable contact 540*a* is grounded, while the contacts 540*b* and 540*c* are connected to terminals or leads 542 and 544**, designated N.O. HIGH and N.C. HIGH.

Figure 13:
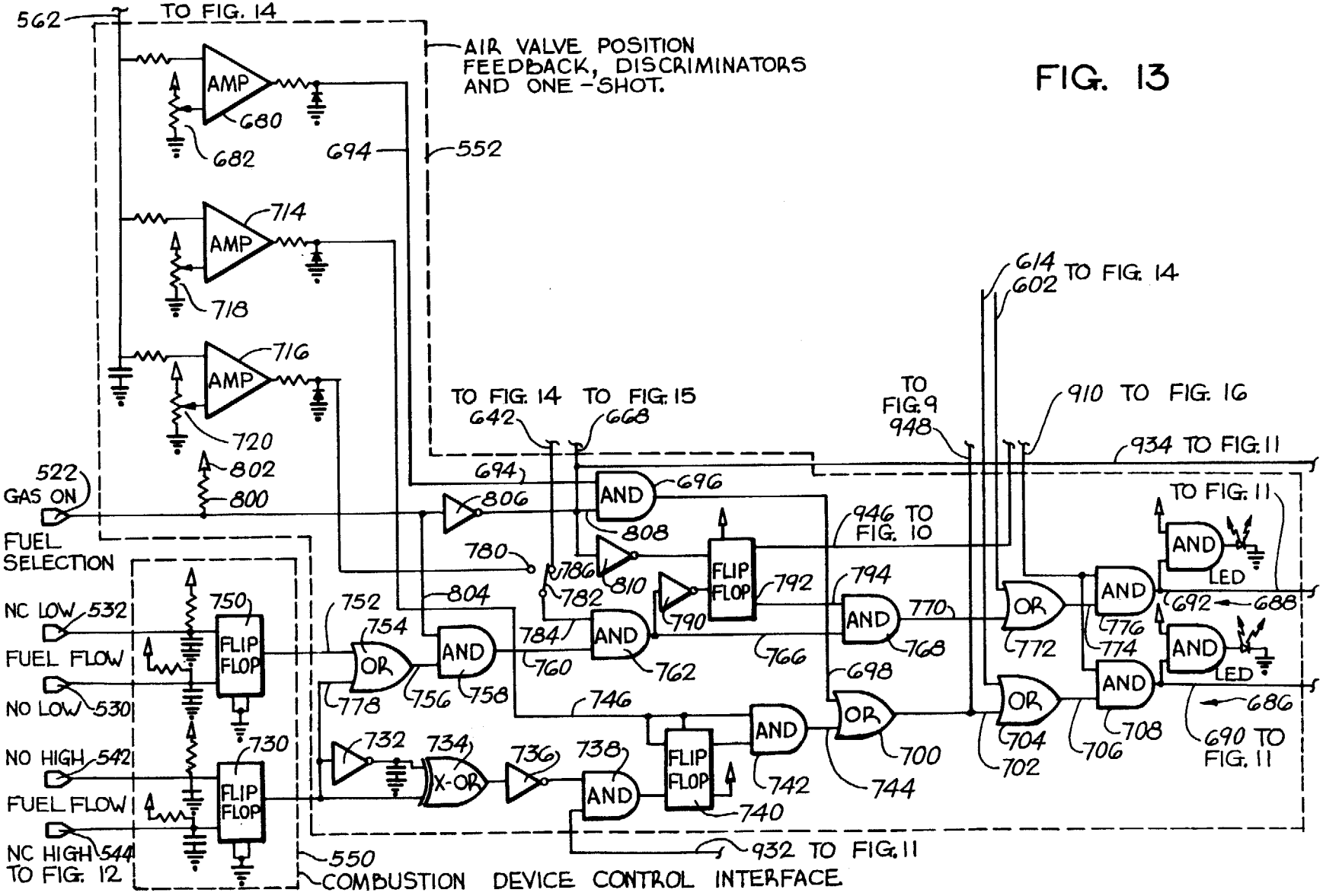
FIGS. 13–16 are schematic diagrams of additional electronic circuits employed in the combustion control system.
Figure 14:
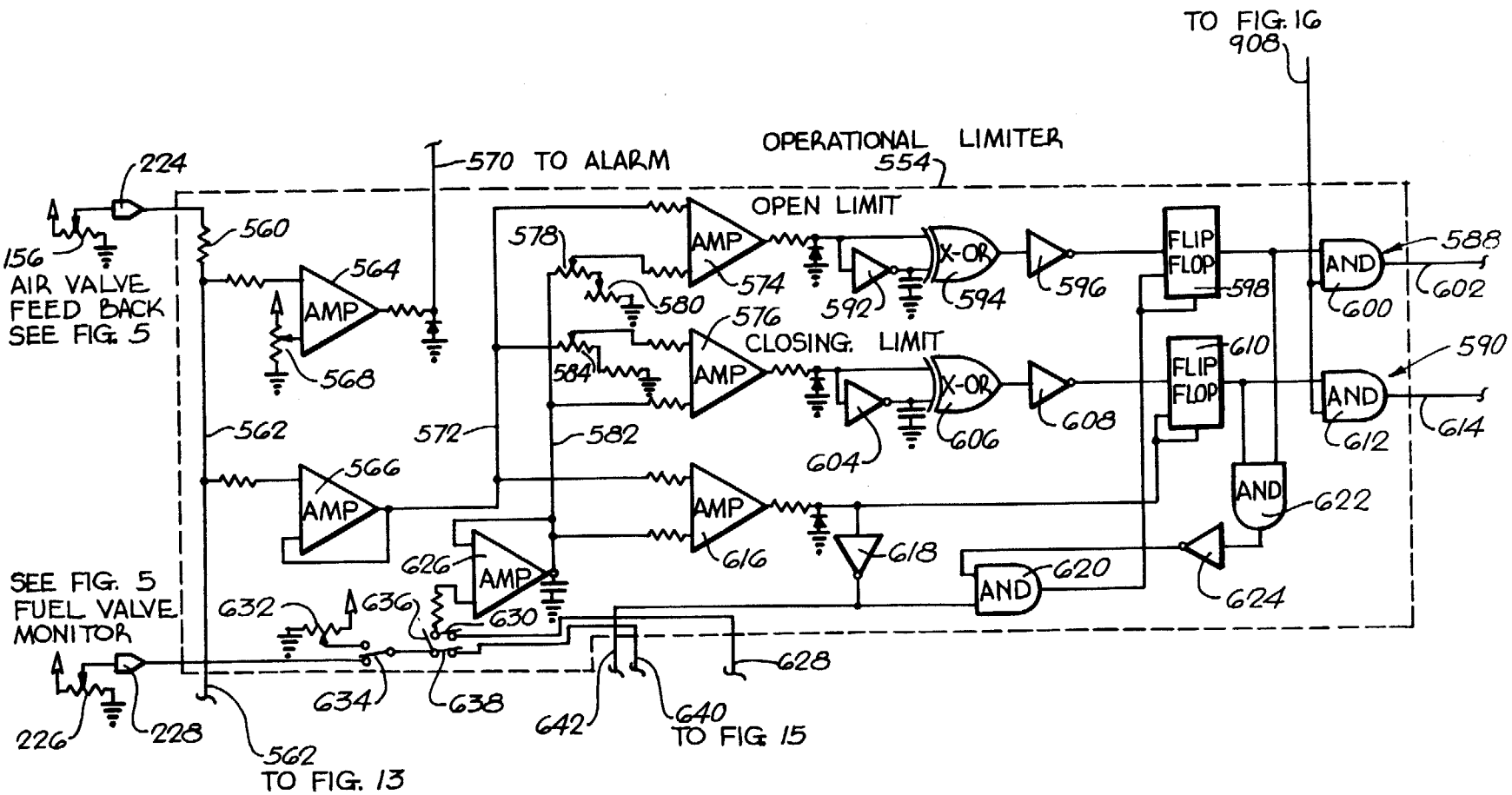

FIGS. 13 and 14 illustrate additional electronic circuits 550, 552 and 554, designated COMBUSTION DEVICE CONTROL INTERFACE, AIR VALVE POSITION FEEDBACK, DISCRIMINATORS and ONE SHOT, and OPERATIONAL LIMITER, respectively. The control terminals 522, 530, 532, 542 and 544 of FIG. 12 also appear in FIG. 13 and form the inputs to the combustion device control interface circuit 550.

The AIR VALVE POSITION FEEDBACK potentiometer 156 of FIGS. 3 and 5 also appears in FIG. 14, as an input device for the operational limiter circuit 554 and the air valve position feedback circuit 552 of FIG. 13. The fuel valve feedback or monitor potentiometer 226 of FIG. 5 also appears in FIG. 14 as an input device for the operational limiter circuit 554.

In FIG. 14, the terminal 224, connected to the slider of the air valve feedback potentiometer 156, is connected through a resistor 560 to a line 562, which is connected to the inputs of operational amplifiers 564 and 566 in the operational limiter circuit 554. The operational amplifier 564 operates the alarm circuit to shut down the combustion device if the air valve closes too far. This limit is set by an adjustable potentiometer 568 connected to the other input of the amplifier 564. The output of the amplifier 564 is connected to a lead 570 which goes to the alarm circuit, as will be described presently.

The operational amplifier 566 is operated at unity gain and has its output connected to a line 572 which is connected to the inputs of operational amplifiers 574 and 576 for establishing operational limits upon the movement of the air valve, during normal operating conditions of the combustion device or furnace. The amplifier 574 establishes the maximum open limit while the amplifier 576 establishes the maximum closed limit of the air valve during operational conditions. The open limit may be adjusted by means of potentiometers 578 and 580, connected in a circuit between the other input of the amplifier 574 and a reference line 582, which is also connected to the reference input of the amplifier 576. The closing limit may be adjusted by means of a potentiometer 584, connected in an adjusting circuit between the line 572 and the control input of the amplifier 576.

The outputs of the opening limit and closing limit amplifiers 574 and 576 are connected to control channels 588 and 590 which are adapted to cause the air valve to close and open, respectively. The channel 588 comprises an inverter Schmitt trigger 592, an exclusive OR gate 594, an inverter Schmitt trigger 596, a flipflop 598 and an AND gate 600 having an output line 602. Similarly, the channel 590 comprises an inverter Schmitt trigger 604, an exclusive OR gate 606, an inverter Schmitt trigger 608, a flipflop 601, and an AND gate 612 having an output line 614. When the flipflop 598 is set, the air valve is driven in a closing direction. When the flipflop 610 is set, the air valve is driven in an opening direction, as will be described in greater detail presently.

An additional operational amplifier 616 is provided to reset the flipflops 598 and 610 at an intermediate position, between the opening limit and the closing limit established by the amplifiers 574 and 576. The inputs of the amplifier 616 are connected to the control line 572 and the reference line 582. The output of the amplifier 616 is connected to the reset input of the flipflop 610. An inverting Schmitt trigger 618 and an AND gate 620 are connected between the output of the amplifier 616 and the resetting input of the flipflop 598. Another AND gate 622 and an inverting amplifier 624 are connected between the outputs of the flipflops 598 and 610 and the other input of the AND gate 620.

The voltage on the reference line 582 is controlled by another operational amplifier 626 having its output connected to the reference line 582. The input of the amplifier 626 is adapted to be supplied with a signal representing the rate of fuel flow, such signal being supplied by a line 628 through a switch or jumper 630. The signal on the line 628 is controlled by the setting of the fuel feedback or monitoring potentiometer 226. As an alternative, the input of the amplifier 626 may be supplied with an adjustable internal voltage, derived from a variable potentiometer 632, the slider of which is adapted to be connected to the input of the amplifier 626 through a two position selector switch 534 and a switch or jumper 636. The selector switch 634 selects between the fuel feedback potentiometer 226 and the adjustable internal potentiometer 632. It is also possible to connect the slider of the fuel feedback potentiometer 226 to the input of the amplifier 626, through the switches 634 and 636. As a further alternative, the slider of the fuel feedback potentiometer 226 may be connected through the selector switch 634 and another switch or jumper 638 to a line 640.

In FIG. 14, an additional output line 642 is connected to the output of the inverting Schmitt trigger 618 which has its input connected to the resetting operational amplifier 616.

Figure 15:
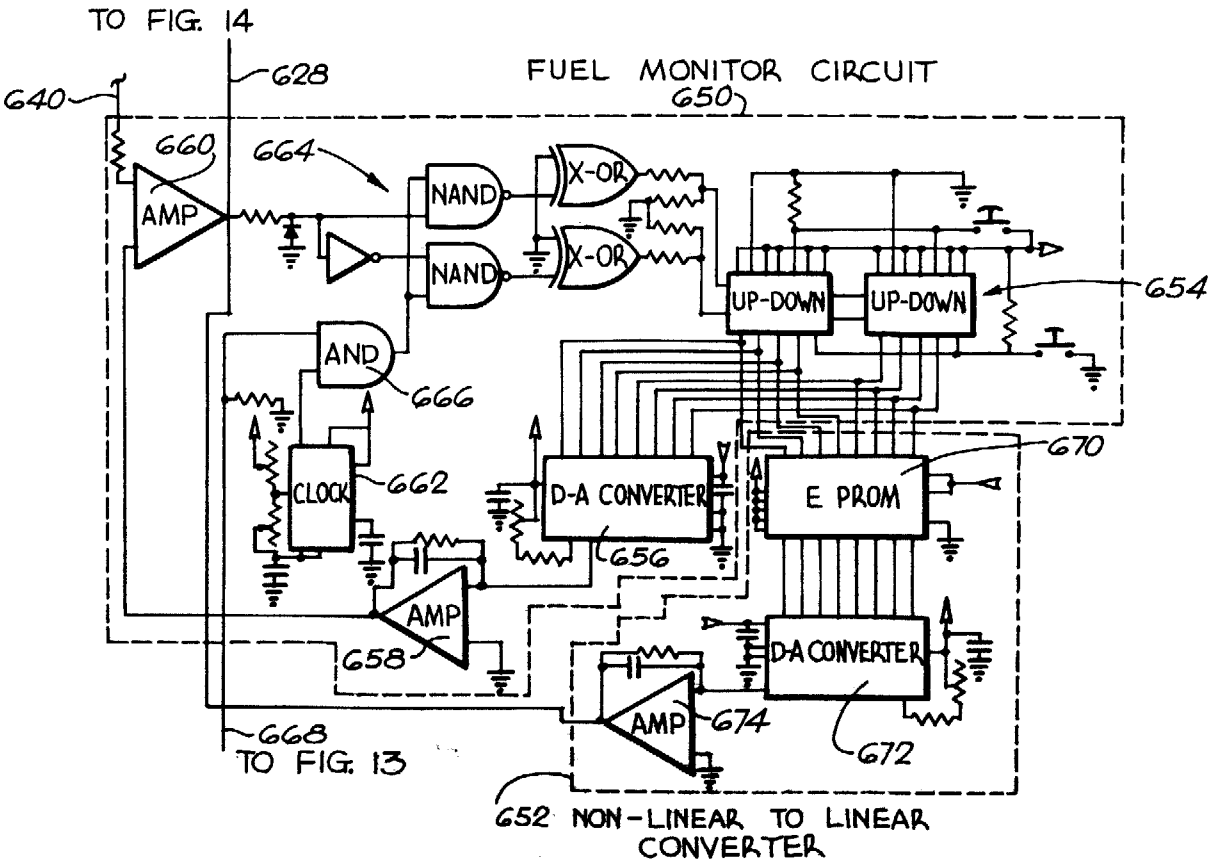

The lines 628 and 640 of FIG. 14 also appear in FIG. 15, which illustrates electronic circuits 650 and 652, designated FUEL MONITOR CIRCUIT and NON-LINEAR TO LINEAR CONVERTER. The line 640 supplies a non-linear signal, representing the rate of fuel flow, from the fuel valve feedback potentiometer 226. The circuits 650 and 652 convert the non-linear analog signal on the line 640 into a programmable linear analog signal on the line 628, such signal being employed to control the air valve limits, through the operational limiter circuit 554 of FIG. 14.

The fuel monitor circuit 650 of FIG. 15 is basically an analog-to-digital converter, utilizing an up-down counter 654 to produce the digital signals. Such digital signals are converted to analog signals by a D-A CONVERTER 656, the analog output signal of which is amplified by an amplifier 658 having its output connected to one input of an operational amplifier 660, serving as a comparator. The analog input line 640 is connected to the other input of the comparator amplifier 660. The up-down counter 654 is loaded with timing pulses from a clock circuit 662, through an up-down gate system 664, controlled by the output of the comparator amplifier 660. To provide for enabling and disabling of the circuit 650, an AND gate 666 is connected between the clock 662 and the up-down gate system 664. One input of the AND gate 666 is connected to an input line 668, whereby the AND gate may be shut down.

The digital outputs of the up-down counter system 654 are connected to the inputs of a programmable memory 670, employed in the converter circuit 652. A memory 670 may be programmed to provide a desired linear output in response to a non-linear input. The output of the programmable memory 670 is in digital form and is converted to analog form by a D-A converter 672. The linear analog output of the D-A converter 672 is amplified by an amplifier 674 having its output connected to the output line 628, extending to the operational limiter circuit 554 of FIG. 14, where the linear analog signal controls the limits for the air valve 66.

The air valve feedback line 562 extending from the air valve feedback potentiometer 156, shown in FIG. 14, also extends to FIG. 13, where the line 562 serves as an input for the air valve position feedback, discriminators and one-shot circuit 552. The line 562 is connected to one input of an operational amplifier 680 having the other input connected to the slider of a variable potentiometer 682. The amplifier 680 causes the air valve 66 to be driven to its fully open position, when the combustion device or furnace is in a standby condition. To cause opening and closing of the air valve 66, the circuit 552 of FIG. 13 includes an opening channel 686 and a closing channel 688 having output lines 690 and 692, respectively, extending to the alternate input lines of the OR gates 500 and 494, respectively, of the air valve driver circuit 444 in FIG. 11. A signal on the line 690 causes the air valve 66 to be driven continuously toward its open position. A signal on the line 692 causes the air valve to be driven continuously toward its closed position.

In FIG. 13, the output of the operational amplifier 680 is connected to a line 694 extending to one input of an AND gate 696 having its output connected to one input 698 of an OR gate 700. The output of the OR gate 700 is connected to one input 702 of an OR gate 704 having its output connected to one input 706 of an AND gate 708, the output of which is connected to the valve opening line 690. The gates 700, 704 and 708 are components of the valve opening channel 686.

In the circuit 552 of FIG. 13, the air valve feedback line 562 is also connected to the control inputs of operational amplifiers 714 and 716 which provide high and low limits for the air valve 66, depending on whether the combustion device is calling for a high fuel rate or a low fuel rate. The reference inputs of the amplifiers 714 and 716 are connected to variable potentiometers 718 and 720, whereby the limits can be adjusted.

In the combustion device controlled interface 550, the high fuel flow input terminals 542 and 544 are connected to the inputs of a flipflop 730 having its output connected through an inverting Schmitt trigger 732, an exclusive OR gate 734, an inverting Schmitt trigger 736, an AND gate 738, a flipflop 740, and an AND gate 742, to the alternate input 744 of the OR gate 700. The output of the operational amplifier 714 is connected to a line 746, extending to the other input of the flipflop 740, and also to the other input of the AND gate 742.

The low fuel flow input terminals 530 and 532 are connected to the inputs of a flipflop 750 having its output connected to one input 752 of an OR gate 754, the output of which is connected to one input 756 of an AND gate 758. The output of the AND gate 758 is connected to one input 760 of an AND gate 762, the output of which is connected to one input 766 of an AND gate 768, having its output connected to one input 770 of an OR gate 772. It will be seen that the output of the OR gate 772 is connected to one input 774 of an AND gate 776, having its output connected to the valve closing line 692.

The output of the flipflop 730 is also connected to the alternate input 778 of the OR gate 754. The output of the operational amplifier 716 is connected to one fixed contact 780 of a selector switch 782 having its movable contact connected to the other input 784 of the AND gate 762. The other fixed contact 786 of the switch 782 is connected to the line 642, extending to the operational limiter circuit 554 of FIG. 14. The selector switch 782 makes it possible to switch out the output of the amplifier 716, and to switch in the signals from the amplifier 616, which are under the control of the fuel valve monitor potentiometer 226.

The output of the AND gate 762 is also connected through an inverting Schmitt trigger 790 to one input of a flipflop 792, having one output connected to the other input 794 of the AND gate 768.

In FIG. 13, the terminal 522 designated GAS ON, also appears. It will be recalled that this terminal 522 is connected to ground when GAS fuel is called for. A resistor 800 is connected between the terminal 522 and a power supply terminal 802. The terminal 522 is connected to the second input 804 of the AND gate 758. In addition, the terminal 522 is connected through an inverter 806 to the second input 808 of the AND gate 696. The output of the inverter 806 is connected through an inverter 810 to the second input of the flipflop 792. The output of the inverter 802 is also connected to the line 668 which extends to FIG. 15 and is connected to the second input of the AND gate 664. When gas flow is called for, the fuel monitor circuit 650 of FIG. 15 is thereby disabled.

Figure 16:
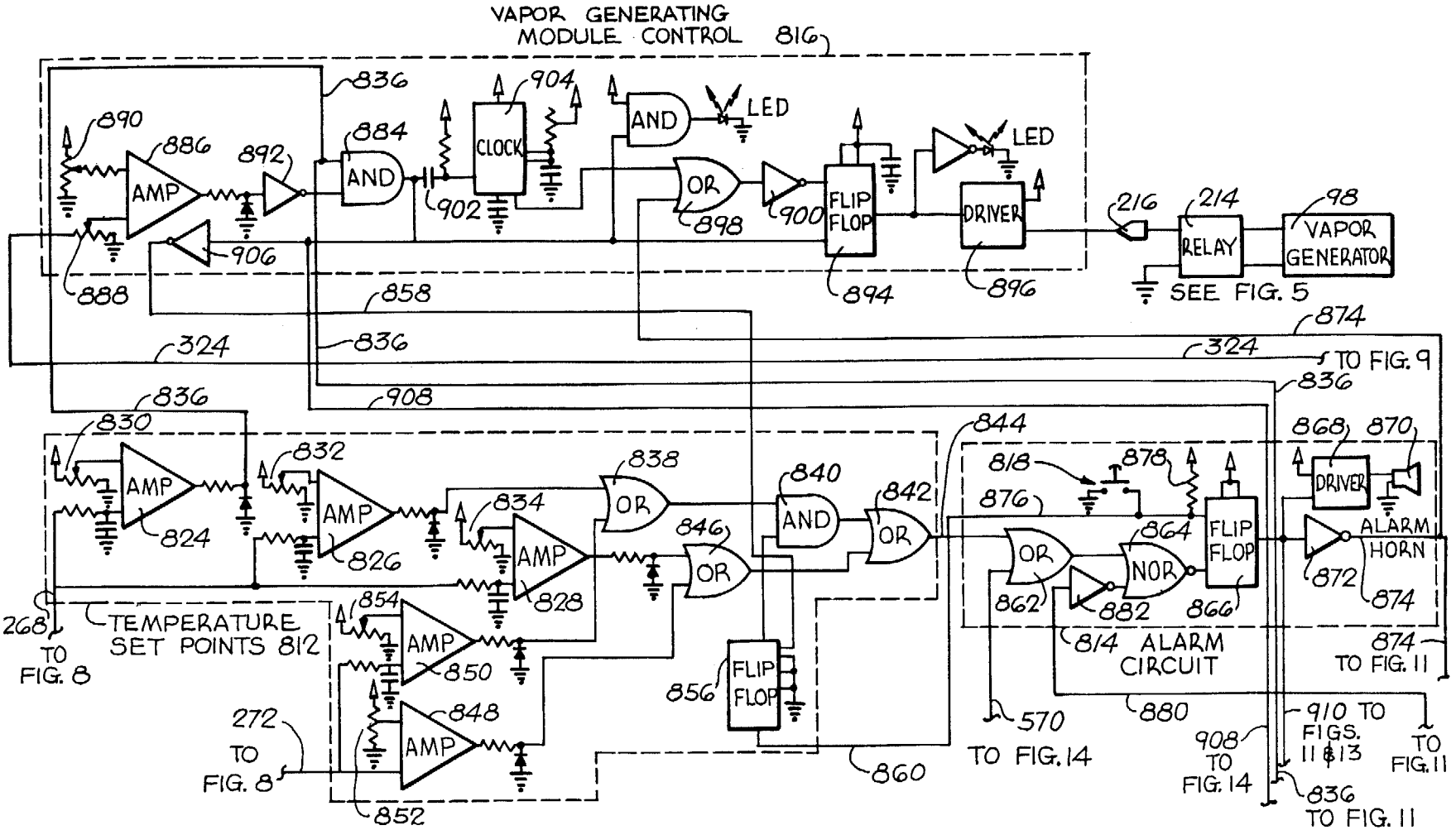

FIG. 16 illustrates electronic circuits 812, 814 and 816, designated TEMPERATURE SET POINTS, ALARM CIRCUIT and VAPOR-GENERATING MODULE CONTROL, respectively. The TEMPERATURE SET POINTS CIRCUIT 812 provides temperature limits within which the combustion control system will operate. Temperatures which fall outside such limits result in a triggering pulse to the ALARM CIRCUIT 814. More specifically, the ALARM CIRCUIT 814 is triggered when either the combustion chamber temperature or the exhaust temperature falls outside the predetermined limits.

The alarm circuit 814 is also triggered by the operational limiter circuit of FIG. 14 if the air valve 66 closes beyond a predetermined position. Furthermore, the alarm circuit 814 is triggered when there is a failure in the production or transmission of the operational pulses, normally produced by the operational clock and pulse divider circuit 366 of FIG. 10.

When the alarm circuit 814 receives a triggering pulse, due to any of the above mentioned conditions, the alarm circuit is activated so as to energize an audible or visual signal, or both. In addition, the alarm circuit 814 transmits a signal to the air valve driver circuit 444 of FIG. 11, thus causing the air valve 66 to be opened to its fullest extent. The alarm circuit 814 includes a reset switch 818 which may be manually operated to deactivate the alarm circuit, thus allowing the entire operational electronics in the processor system 80 to resume normal operation, while also deactivating the alarm signal.

The vapor-generating module control circuit 816 of FIG. 16 has two inputs, one from the calibrate and thermocouple input circuits 250 of FIG. 8, and the other from the D-A CONVERTER CIRCUIT 350 of FIG. 9. Only when both inputs are energized can the vapor-generating module control circuit 816 be activated, thus energizing the vapor generator drive unit 98 of FIGS. 1 and 5. The vapor-generating unit 98 remains on as long as both inputs to the control circuit 816 are energized. If neither or both inputs are deenergized, the vapor-generating unit 98 is deenergized and cannot be reactivated until the processor 80 is recycled.

FIG. 11 illustrates additional electronic circuits, designated MISSING PULSE DETECTOR 820, and FALSE PULSE GATE 822. The MISSING PULSE DETECTOR 820 develops a preset time interval during which the circuit must acknowledge a pulse from the operational clock and pulse divider circuit 366 of FIG. 10, after such pulse passes through the air valve direction determiner circuit 440 of FIG. 11, the air valve timer circuit 442, and the air valve driver circuit 444. When a pulse has not been acknowledged during this preset time interval, the missing pulse detector circuit 820 of FIG. 11 transmits a pulse to the alarm circuit 814 of FIG. 16.

The false pulse gate circuit 822 of FIG. 11 provides a pulse to the input of the missing pulse detector circuit 820 at any time during normal operation when pulses from the operational clock and pulse divider circuit 366 do not reach the air valve driver 444, such as when the combustion device or furnace is off, awaiting firing, in a pre-purge or purged condition, or has just fired up and the combustion chamber temperature is not high enough to gate in the operational clock and pulse divider circuit 366 by means of the temperature set points circuit 812 of FIG. 16. Another such time occurs during the ramping mode when no operational pulse can alter the state of the circuit after the lock-in gate circuit 364 of FIG. 10.

In FIG. 16, the temperature set points circuit 812 includes three operational amplifiers 824, 826 and 828 having their controlled inputs connected to the combustion temperature line 268, extending from the output of the amplifier 252 of FIG. 8. Such amplifier 252 receives its input from the combustion temperature thermocouple 76, so that the signal on the line 268 represents the combustion temperature. The reference inputs of the operational amplifiers 824, 826 and 828 receive adjustable reference voltages from potentiometers 830, 832 and 834. The output of the amplifier 824 is connected to a line 836 extending to the vapor-generating module control circuit 816, to provide one of the signals necessary to start the vapor generator 98. Such signal appears on the line 836 when the combustion temperature reaches a level which is high enough for operation of the vapor generator 98, such level being determined by the setting of the potentiometer 830.

The operational amplifier 826 establishes a lower limit for the combustion temperature, below which the alarm circuit 814 is activated. The operational amplifier 828 establishes an upper limit for the combustion temperature, above which the alarm circuit 814 is actuated. The output of the amplifier 826 is connected to one input of an OR gate 838 having its output connected to one input of an AND gate 840, the output of which is connected to one input of an OR gate 842. The output of the OR gate 842 is connected to a line 844 which extends to the alarm circuit 814. When the combustion temperature drops below the limit established by the amplifier 826, the gates 838, 840 and 842 transmit an activating signal to the alarm circuit 814.

The output of the amplifier 828 is connected to one input of an OR gate 846 having its output connected to the alternate input of the OR gate 842. When the combustion temperature exceeds the limit established by the amplifier 828, a signal is transmitted by the gates 846 and 842 to the alarm circuit 814, to activate such circuit.

The temperature set points circuit 812 includes two additional operational amplifiers 848 and 850 which establish upper and lower limits for the exhaust temperature. Thus, the control inputs of the amplifiers 848 and 850 are connected to the line 272, extending from the output of the amplifier 270 of FIG. 8, which receives its input from the exhaust thermocouple 78. The upper and lower limits are established by potentiometers 852 and 854 connected to the reference inputs of the amplifiers 848 and 850. The output of the amplifier 848 is connected to the alternate input of the OR gate 846. When the exhaust temperature exceeds the limit established by the amplifier 848, the gates 846 and 842 transmit an activating signal to the alarm circuit 814.

The output of the amplifier 850 is connected to the alternate input of the OR gate 838. When the exhaust temperature drops below the limit established by the amplifier 850, the gates 838, 840 and 842 transmit an activating signal to the alarm circuit 814.

The temperature set point circuit 812 also includes a flipflop 856 having its output connected to the second input of the AND gate 840, to disable the AND gate 840 during startup, while enabling the AND gate during normal operating conditions of the combustion device. The input of the flipflop 856 is connected to a line 858 extending to the vapor-generating module control circuit 816, to receive a signal during normal operation of the combustion device. The resetting input of the flipflop 858 is connected to a line 860, extending to the alarm circuit 814.

In FIG. 16, the line 844 functions as the input line for the alarm circuit 814 and is connected to one input of an OR gate 862 having its output connected to one input of a NOR gate 864, the output of which is connected to the input of a flipflop 866. Any triggering pulse on the line 844 sets the flipflop 866, the output of which is connected to the input of a driver circuit 868, having its output connected to an alarm signal 870, which may produce an audible or visible alarm, or both. As shown, the alarm signal 870 is in the form of an alarm horn, for producing an audible alarm signal. The output of the flipflop 866 is also connected to the input of an inverter 872 having its output connected to an alarm output line 874, adapted to supply signals to shut down the electronic control system and the combustion device.

The flipflop 866 has a resetting input 876, supplied with a biasing voltage by a resistor 878. The resetting switch 818 is connected between the resetting input 876 and ground, so that momentary closure of switch 818 resets the flipflop 866 and deactivates the alarm circuit 814.

The alarm circuit 814 of FIG. 16 has an additional input in the form of the line 570, extending from the output of the operational amplifier 564 in the operational limiter circuit 554 of FIG. 14. The line 570 is connected to the alternate input of the OR gate 862, so that the signal on the line 670 activates the alarm circuit if the air valve closes too far, as determined by the operational amplifier 564.

The alarm circuit 814 has still another input in the form of a line 880, connected through an inverter 882 to the alternate input of the NOR gate 864. The input line 880 extends to the missing pulse detector circuit 820 of FIG. 11.

As already indicated, the vapor-generating module control circuit 816 of FIG. 16 receives one of its inputs by way of the line 836 from the output of the operational amplifier 824, which is responsive to the attainment of a predetermined combustion temperature. The input line 836 is connected to one input of an AND gate 884. The other input to the vapor-generating module control circuit 816 is provided by the line 324, extending from the output of the D-A converter 350 of FIG. 9. The signal on the line 324 represents the summation temperature, constituting the summation of the combustion temperature and the exhaust temperature. The line 324 is connected to the control input of an operational amplifier 886, such input being provided with a gain control in the form of a potentiometer 888. The reference input of the amplifier 886 is supplied with an adjustable reference voltage by a variable potentiometer 890. The output of the amplifier 886 is connected through an inverter 892 to the second input of the AND gate 884. Thus, the AND gate 884 is enabled when the output signal on the line 324 from the D-A converter 350 attains the preset level, as established by the potentiometer 890, provided the combustion temperature has also attained the preset level.

The output of the AND gate 884 is connected to the setting input of a flipflop 894 having its output connected to the input of a driver circuit 896, the output of which is connected to the input terminal 216 of the control relay 214 for the vapor-generator unit 98 of FIGS. 1 and 5.

The alarm output line 874 is connected to one input of an OR gate 898 having its output connected through an inverter 900 to the resetting input of the flipflop 894. Thus, an alarm output signal on the line 874 shuts down the vapor generator 98. The output of the AND gate 884 is coupled through a coupling capacitor 902 to the input of a clock or timer 904 having its output connected to the alternate input of the OR gate 898. When the AND gate 884 is disabled, by the loss of either input, the capacitor 902 transmits a brief pulse to the timer 904, which transmits a pulse to the OR gate 898, so as to reset the flipflop 894, thereby shutting down the vapor generator 98.

The output of the AND gate 884 is connected through an inverter 906 to the line 858 which extends to the input of the flipflop 856 in the temperature set points circuit 812. When the AND gate 884 is enabled, the flipflop 856 is operated so as to enable the AND gate 840 in the temperature set points circuit 812.

The output of the AND gate 884 is also connected to an output line 908, extending to the operational limiter circuit 554 of FIG. 14. When the AND gate 884 is enabled, indicating normal operating conditions, the signal on the line 908 enables the gates 600 and 612, so that the operational limiter circuit 554 is activated.

The line 836, extending from the output of the operational amplifier 824, also extends to the false pulse gate circuit 822 in FIG. 11 and forms one of the inputs of such circuit.

The output of the flipflop 866 in the alarm circuit 814 is connected to an alarm output line 910, extending to the second inputs of the AND gates 708 and 776 in the air valve position feedback, discriminators and one-shot circuit 552 of FIG. 13.

The alarm output line 910 also extends to the false pulse gate circuit 822 of FIG. 11 and forms another input for such circuit.

The alarm output circuit 874 in FIG. 16 also extends to FIG. 11 and is connected to the alternate input of the OR gate 502 in the air valve driver circuit 444. An alarm signal on the line 874 causes the air valve to be driven to its fully open position.

As previously indicated, the missing pulse detector 820 of FIG. 11 provides a time interval during which an operational clock pulse must be transmitted to the air valve driver circuit 444. Otherwise, the missing pulse detector 820 transmits an actuating pulse to the alarm circuit 814 of FIG. 16.

As shown in FIG. 11, the missing pulse detector circuit 820 includes an OR gate 912 having one input connected to the output of the OR gate 500 in the valve opening channel 492 of the air valve driver 444. The output of the OR gate 912 is connected to one input of a NOR gate 914 having its alternate input connected to the output of the OR gate 494 in the valve closing channel 491 of the air valve driver circuit 444. Thus, if pulses appear at either the output of the OR gate 494 or the output of the OR gate 500, pulses will appear at the output of the NOR gate 914. It will be seen that the output of the NOR gate 914 is connected to one input of a clock or electronic timer 916, so that the output pulses will set the timer. A transistor 918 is connected between the output of the gate 914 and a timing capacitor 920 which is connected to the resetting input of the timer 916. As long as the pulses keep coming from the gate 914, the capacitor 920 is not allowed to charge sufficiently to trigger the timer 916. However, if the pulses stop coming for a sufficient interval, the capacitor 920 is charged through a variable timing resistor 922, with the result that the timer 916 transmits a pulse to the line 880 which extends to the input of the alarm circuit 814 in FIG. 16, whereby the alarm circuit is activated, to shut down the combustion device and the control system.

As previously indicated, the false pulse gate circuit 822 of FIG. 11 provides pulses to the input of the missing pulse detector 820 at various times during normal operation when operational pulses do not reach the air valve driver 444, including times when the combustion device is off, awaiting firing, in pre-purge or purge, or as just fired up and the combustion chamber temperature is not high enough to gate in the operational pulses by means of the temperature set points circuit 812. Another such time is during the ramping mode when no operational pulse can alter the state of the circuit after the lock-in gate circuit 364.

As shown in FIG. 11, the false pulse gate circuit 822 includes an AND gate 924, having its output connected to the alternate input of the OR gate 912 in the missing pulse detector circuit 820. One input of the AND gate 924 is connected to the line 384 extending to the output of the operational clock and pulse divider circuit 366 of FIG. 10. Thus, the line 384 delivers the operational pulses to one input of the AND gate 924 at all times. The condition of the other input determines whether the pulses are transmitted to the missing pulse detector circuit 820.

One input to the false pulse gate 822 is provided by the line 450, extending to the output of the flipflop 400 in the lock-in gate circuit 364 of FIG. 10. As shown in FIG. 11, the line 450 is connected to one input of an OR gate 926, having its output connected to one input of an OR gate 928, the output of which is connected to the second input of the AND gate 924. Thus, a signal on the line 450 enables the AND gate 924.

As previously indicated, the line 836 forms another input of the false pulse gate 822. An inverter 930 is connected between the line 836 and the alternate input of the OR gate 926. It will be recalled that the line 836 extends to the output of the operational amplifier 824 in the temperature set points circuit 812 of FIG. 16. The output of the amplifier 824 changes between a low temperature signal and a normal temperature signal when the normal operating temperature range is attained. A low temperature signal on the line 386 enables the AND gate 924 so that operational pulses are supplied to the missing pulse detector circuit 820.

The output of the inverter 930 is also connected to a line 932 extending to the second input of the AND gate 738 in the air valve position feedback circuit 552 of FIG. 13. Thus, the AND gate 738 is enabled by an enabling signal on the line 932, which occurs under low temperature conditions.

The alternate input of the OR gate 928 is connected to a line 934, which extends to FIG. 13, where the line 934 is connected to the output of the inverter 806, to which the line 668 is also connected.

In the false pulse gate circuit 822, the output of the inverter 930 is also connected to one input of an OR gate 936 having its output connected to a line 938 extending to FIG. 10, where the line 938 is connected to the alternate input of the NOR gate 412 in the lock-in gate circuit 364.

The false pulse gate 822 includes an AND gate 940 having its two inputs connected to the lines 836 and 910 in FIG. 16. The output of the gate 940 is connected to a line 942 extending to FIG. 10, where the line 942 is connected to one input of an AND gate 944 having its output connected to the second input of the AND gate 404. The second input of the AND gate 944 is connected to a line 946 extending to FIG. 13, where the line 946 is connected to one output of the flipflop 792.

Returning to FIG. 14, the output lines 602 and 614 of the operational limiter circuit 554 extend to FIG. 13, where the line 602 is connected to the alternate input of the OR gate 772. The line 614 is connected to the alternate input of the OR gate 704. A signal on the line 602 causes the air valve 66 to be driven toward its closed position, provided the AND gate 776 is enabled. A signal on the line 614 causes the air valve 66 to be driven toward its open position, provided the AND gate 708 is enabled.

In FIG. 13, a line 948 is connected to the output of the OR gate 700, to extend to FIG. 9, where the line 948 is connected to one input of an AND gate 950 in the UP/-DOWN counter circuit 352.

It may be helpful to summarize the operation of the combustion system 40, as shown generally in FIG. 1. The operation of the modified combustion system 110 of FIG. 2 is of a very similar character.

In summarizing the operation, it will be assumed initially that the combustion system 40 of FIG. 1 has been in operation long enough for its load demand to have become fulfilled, so that the furnace boiler 42 is not firing but is awaiting an increase in load demand that will cause it to fire once again. At this stage, the processor or control system 80 is also on standby, with the air valve 66 open. The false pulse gate 822 of FIG. 11 is supplying pulses from the operational clock and pulse divider 366 of FIG. 10 to the missing pulse detector 820 of FIG. 11, to neutralize it.

When the heating load calls for additional heat, the boiler 42 is activated, whereupon the burner blower 64 is turned on, with the internal air damper open. This causes a rush of air to pass through the combustion chamber 44 and up the stack 60, thus removing all residual gases from the combustion chamber. This cycle is known as "pre-purge". The control system 80 remains in a standby condition, with the air valve 66 and the false pulse gate 822 open. At the completion of the pre-purge cycle, the fuel igniter of the burner 46 is energized for a definite period. During the last portion of this ignition phase, the fuel valve 48 is opened, and a continuous signal is transmitted from the combustion device control unit 92 through the combustion device interface circuit 94 to the combustion device interface circuit 550 to the air valve position feedback, discriminators and one-shot circuit 552, and also to the operational limiter circuit 554. In turn, the air valve position feedback circuit 552 of FIG. 13 supplies a continuous signal to the air valve driver circuit 444 of FIG. 11, so that it delivers a continuous voltage to the air valve motor 136, in a direction such that the air valve 66 begins to close. The air valve feedback potentiometer 156 simultaneously sends a continuous, variable signal to the air valve position feedback circuit 552 and to the operational limiter circuit 554. The amplitude of such variable signal is proportional to the position of the air valve 66. Such variable signals informs the air valve position feedback circuit 552 that the air valve 66 has not yet reached a predetermined position. When the air valve 66 does reach such predetermined position, as determined by a set point in the air valve position feedback circuit 552, the continuous signal from such circuit is no longer supplied to the air valve driver 444, with the result that the air valve motor 136 is stopped, so that the variable feedback signal from the air valve feedback potentiometer 156 to the feedback circuit 552 and the operational limiter circuit 554 continues, but ceases to vary.

This predetermined position of the air valve 66 is employed only during the first operational sequence after the firing of the boiler 42 is started (hence, the name "one-shot"). This position is such as to allow for a high degree of startup combustion efficiency, as determined by measurement during installation. The boiler 42 continues to operate in this manner under these conditions, but the control system 80 continues its operational sequence.

The combustion thermocouple 76 and the exhaust thermocouple 78 generate voltages corresponding to the combustion and exhaust temperatures and transmit such voltages continuously to the calibrate and thermocouple input circuits 250 of FIG. 8, which amplify them and transmit the amplified voltages to the vapor-generating module control circuit 816 of FIG. 16, and also to the amplifiers and DC offsets 280 of FIG. 8 and the temperature set points 812 of FIG. 16. When the voltage representing the combustion chamber temperature reaches a level determined by the adjustment of the temperature set points circuit, signals are transmitted from such circuit to the false pulse gate 822 of FIG. 11, shutting it down, and to the lock-in gate 364, enabling it for handling the operational pulses from the operational clock and pulse divider circuit 366 of FIG. 10. The frequency of the operational pulses is adjusted during installation in accordance with the size and inertia of the boiler. The operational pulses determine the updating frequency of the control system 80.

The first operational pulse is sent to the lock-in gate 364 of FIG. 10, causing it to open, whereupon it produces a voltage level which is transmitted to both the air valve direction determiner circuit 440 and the air valve timer circuit 444 of FIG. 11. This voltage level also opens the false pulse gate 822 again. Such voltage level indicates to the air valve direction determiner 440 that the air valve 66 is to move in one direction or the other, depending only on the random choice of the determiner circuit for this initial instance. The initial direction of movement is of no consequence to the operation of the control system. The voltage level to the air valve timer 444 instructs it to produce a pulse for a time interval determined by the adjustment of the timer. Such timing pulse is transmitted to the air valve direction determiner 440, which relays a signal to the air valve driver 444, so as to cause the air valve 66 to open or close for the timed interval. As just indicated, the direction is determined by the random initial selection of the determiner circuit 440. The length of the time interval determines the distance travelled by the slidable gate 130 of the air valve 66. Accordingly, the length of the timing pulse produced by the air valve timer 442 is adjusted so as to cause the slidable gate 130 of the air valve 66 to move a distance which is just great enough to produce a temperature change in the combustion chamber 44, measurable by the thermocouple 76.

The voltage level produced by the lock-in gate 364 of FIG. 10 due to the first operational pulse is also transmitted to the UP/DOWN direction gates 360 of FIG. 9, thus causing the UP gate to open, allowing the pulses from the scan rate clock 362 of FIG. 10 to be transmitted through the UP gate to actuate the UP/DOWN counters 352, so as to begin a ramping mode. During this initial sequence, it is the UP gate which is opened, because, when the boiler 42 last ceased firing after fulfilling its load demands and placed the control system 80 on standby, the UP/DOWN direction gates 360 were reset to the UP condition by a signal generated in the boiler control unit and processed through the combustion device interface circuit 550 to the UP/DOWN counters 352, to reset them to zero. The counters 352 transmit a binary code representing zero to the D-A converter 350, resetting it to zero. This zero output is transmitted to the discriminator 320 of FIG. 8, with the result that the output of the discriminator is given a positive polarity, which has the effect of setting the UP/DOWN direction gates 360 to UP. Thus, during the initial sequence, the UP/DOWN counters 352 are counted up. The output of the decimal counter section 356 is transmitted to the numerical display 358, which displays the count as a temperature index, for the information of the operator. The output of the binary counter section 354 causes the D-A converter 350 to produce a voltage level corresponding to the binary count. During this initial sequence, the output voltage of the D-A converter 350 begins at zero and ramps upwardly. This ramping voltage is transmitted to the discriminator 320 of FIG. 8, and also to the vapor-generating module control circuit 816 of FIG. 16. The discriminator output is maintained as a positive voltage level which is supplied to the UP/DOWN direction gates 360, the air valve direction determiner 440 of FIG. 11, and the lock-in gate 364 of FIG. 10.

As long as the upward ramping mode continues, the second and any subsequent operational pulses generated by the operational clock and pulse divider circuit 366 are ignored by the lock-in gate 364 with the result that the air valve 66 is not moved. This upward ramping mode is continued until the output voltage level of the D-A converter 350 equals the summation output voltage level of the signal summation circuit 318 of FIG. 8, whereupon the output voltage level produced by the discriminator 320 is reversed in polarity from positive to negative, with the effect of closing the lock-in gate 364. The closure of the lock-in gate 364 reverses the polarity of its output, thus closing the UP/DOWN direction gates 360. As a result, the ramping of the UP/DOWN counters 352 ceases, so that the attained count is maintained constant and is displayed by the numerical displays 358 as the summation temperature index. The D-A counter 350 maintains its output voltage level. The reversed polarity of the output from the lock-in gate 364 also causes the false pulse gate 822 to close, so that such gate no longer transmits pulses to the missing pulse detector 820 of FIG. 11. At this stage, the combustion temperature and the exhaust temperature continue to rise, so that increasing voltage levels are transmitted through the calibrate and thermocouple input circuits 250 of FIG. 8 to the amplifiers and DC offset circuit 280, which amplifies each voltage and develops a DC offset, which is the difference between the thermocouple-generated voltage level and a reference voltage level. The function of the offset is to provide for high gain operation, yet within the output range of the amplifiers. The voltages from the combustion thermocouple 76 and the exhaust thermocouple 78 are amplified and processed separately by the calibrate and thermocouple input circuits 250 and the amplifiers and DC offset circuit 280. The gain controls and the DC offset controls of these circuits are adjusted during installation.

The signal summation circuit 310 provides means for adding or summing its input voltages in such a way that its output is a composite or summation of its inputs. Thus, the exhaust manifold temperature voltage level can be added to the combustion chamber temperature voltage level. Under normal circumstances, the combustion temperature voltage gain in the amplifiers and DC offsets 280 is set higher than the exhaust temperature voltage gain. This adjustment allows the combustion temperature to be predominant in the operation of the control system 80, while the exhaust temperature becomes a correction factor. The role of a correction factor is given to the exhaust temperature because the rate of increase of the combustion temperature voltage is greater than the rate of increase of the exhaust temperature voltage. This continues to be the situation until optimum combustion is attained in the combustion chamber, after which the rate of decrease of the exhaust temperature voltage is greater, and the sum of the two voltages is, for the first time, less than a previous sum. If only the combustion chamber temperature voltage level is taken into account, it will continue to increase after optimum combustion has been attained, and improper combustion will occur.

The output of the discriminator 320 of FIG. 8 is either one of two voltage levels, positive or negative, depending upon the comparison of the output voltage levels of the D-A converter 350 and the signal summation circuit 310. If the signal summation output voltage level is greater than that of the D-A converter 350, the output voltage level of the discriminator 320 is positive. If the output voltage level of the signal summation circuit 310 is less than that of the D-A converter, the output voltage of the discriminator 320 is negative. If the summation output voltage and the D-A converter output voltage remains equal, the polarity of the discriminator output will change with each operational clock pulse.

After the UP/DOWN counters 352 ceased the ramping initiated by the first operational pulse, an equality of voltage levels had been achieved in the discriminator 320 between the outputs of the D-A converter 350 and the signal summation circuit 310. The output of the discriminator 320 had reversed its polarity to negative. The temperature in the combustion chamber, however, continues to rise, and the corresponding voltage levels into and out of the signal summation circuit 310 also continue to increase, thus destroying the equality of voltage levels at the input of the discriminator 320, so that the output of the discriminator is again reversed in polarity from negative to positive.

The next operational pulse from the clock and divider circuit 366 of FIG. 10, after the initial ramping period has ceased, reopens the lock-in gate 364, which once again produces a voltage level to cause the UP gate to open in the UP/DOWN direction gates 360. Accordingly, the UP/DOWN counters 352 are counted upwardly, and the increased count is displayed as a temperature index by the numerical display 358. The increasing count produces an increasing output from the D-A converter 350, until such output equals the voltage from the signal summation circuit 310. The time required to increase by this amount, when compared to the time involved for the initial ramping, taking less than the interval between operational pulses. Once the voltage levels from the D-A converter 350 and the signal summation circuit 310 are again equal, the output of the discriminator 320 is again reversed in polarity from positive to negative, closing the lock-in gate 364, so that it reverses its output polarity, thus closing the UP/DOWN direction gates 360. Accordingly, the ramping mode is halted, and the D-A converter 350 maintains its output voltage level.

With the closing of the lock-in gate 364, it also sends a voltage level to the air valve direction determiner 440 of FIG. 11 and to the air valve timer 444. The determiner 440 assesses the polarity of the output of the discriminator 320 at the same time that the UP gate of the UP/DOWN direction gates is being opened and the air valve timer 442 is being activated. If the polarity of the output of the discriminator 320 is positive, the air valve 66 will be driven in the same direction as it was the time before. If the polarity is negative, the air valve 66 will be driven in the opposite direction. The polarity now is positive. The air valve timer 442 emits its timing pulse of a predetermined length to the air valve direction determiner 440, which in turn relays the timing pulse to the air valve driver 444, for the same direction as was relayed during the previous time. The air valve 66 is thus caused to continue its previous opening or closing movement.

These electrical sequences and the resulting movements of the air valve 66 continue until the summation of the voltage levels representing the combustion temperature and the exhaust temperature is smaller than it was during the previous instance. This smaller summation means that the output voltage of the signal summation circuit 310 is less than the output voltage of the D-A converter 350. This smaller summation voltage causes the output polarity of the discriminator 320 to remain negative. On the next operational pulse from the circuit 366, the air valve direction determiner 440 will be receiving a negative input polarity for the first time. When the timing pulse comes from the air valve timer 442, the output of the determiner 440 will signal a polarity opposite from the previous occasion and will cause the air valve 66 to be driven in an opposite direction, relative to the previous occasion. The operational pulse referred to in the preceding paragraph also causes the lock-in gate 364 to open the DOWN gate in the UP/-DOWN direction gates 360, because the output polarity of the discriminator 320 is negative. The ramping mode is thus begun in a downward direction, so that the counters 352 are counted down, and the output of the D-A converter is decreased accordingly, until such output equals the output of the signal summation circuit 310, thus reversing the output polarity of the discriminator 320 from negative to positive. If the next summation voltage is again less than before, the output of the discriminator 320 will change back to negative, so that the next operational pulse will cause a movement of the air valve 66 to change direction.

If there is no change in the signal summation voltage, during a time interval from one operational clock pulse to the next, there will be a very small difference or overshoot created in the voltage level produced by the D-A converter 350 and sent to the discriminator 320. There will therefore be an almost immediate reversal of the discriminator output polarity, such reversal being due to the hysteresis of the discriminator 320. The operation of the remainder of the control circuit will be the same as described above, when the discriminator output is positive. As long as the signal summation voltage level to the discriminator 320 does not vary, the discriminator will continue to reverse its output polarity with every operational pulse. The practical result of this electronic control is the alternate opening and closing movement of the air valve 66 by a small amount, thus maintaining a virtually constant air intake into the combustion chamber 44.

Inputs other than temperature as registered by the combustion and exhaust thermocouples may be integrated into the information processed by the signal summation circuit 310, if desired. These additional inputs may include devices which sense infrared radiation, pressure, oxygen, carbon monoxide, carbon dioxide, optical transmissibility, air flow, pollution by ionization, acid, humidity, and liquid. The information may be processed in much the same manner as the signals generated by temperature.

The fuel monitor circuit 650 receives information from the fuel monitoring potentiometer 226 in the form of a steadystate but varying voltage, which varies in a nonlinear relationship to fuel flow. The fuel monitor circuit 650 converts the voltage into a binary code which is used to address memory locations in the nonlinear to linear converter 652. Each address within the memory 670 contains information which has been preprogrammed to establish a linear relationship between fuel flow and the voltage in the addressed location. Such voltage is converted into analog form by the converter 672 and is transmitted to the operational limiter circuit 554 for processing.

The operational limiter circuit 554 of FIG. 14 serves two purposes: to limit the total amount of travel of the air valve 66, and to produce an electronic control window or defined zone, which determines the operating range of the air valve 66, depending upon the rate of fuel flow. The operational limiter circuit 554 is adjusted during installation so that the total distance the air valve 66 can travel is limited, resulting in an electronic stop at a position short of complete closure of the valve. When the air valve 66 reaches this preset limit of closure, the operational limiter circuit 554 activates the alarm circuit 814 of FIG. 16, with the result that the air valve 66 is automatically driven to its maximum open limit.

The electronic control window is developed by supplying a voltage range of operation above and below a set point as determined by the fuel flow. This window or defined zone provides a quick response time for the air valve 66 to adjust to changes in fuel flow. Without the window, a much slower response would be made. For example, if the boiler is firing at a relatively low rate of fuel consumption and if the fuel rate is rapidly increased by a sudden increase in load demand, the increased fuel flow is reflected in the output of the nonlinear to linear converter signal 52, in the form of a voltage proportional to the fuel rate increase. When the voltage output suddenly exceeds the upper limit of the electronic control window, a voltage level is produced by the operational limiter 354 and is sent to the air valve driver 444, thus causing the air valve 66 to open rapidly. The voltage output from the air valve potentiometer 156 is sent to the operational limiter 354, where it is compared with the output from the nonlinear to linear converter 652. When equality is attained, the air valve driver 444 is signalled, so that the air valve movement is halted. This position of the air valve 66 becomes the new set point, as determined by the fuel flow, and a new electronic control window is established. If the boiler load demand drops suddenly, the operational sequence takes place in the opposite direction.

The vapor-generating module control 816 of FIG. 16 is activated only when both of its inputs attain predetermined levels which are set during installation, such inputs being derived from the calibrate and thermocouple input circuit 250 of FIG. 8, and from the D-A converter 350. Thus, the vapor-generating module control circuit 816 is not activated until the combustion temperature is sufficiently high, and until the output of the D-A converter is ramped up to a sufficient level, in accordance with the adjustments made during installation. The control circuit 816 then energizes the vapor-generator unit 98, so that the ultrasonic vapor generating head 72 injects an extremely fine mist of water droplets into the combustion air intake.

The alarm circuit 814 of FIG. 16 is activated by any of the following abnormal conditions: excessive combustion chamber temperature; dropping of the combustion chamber temperature below a preset lower limit; excessive exhaust manifold temperature; dropping of the exhaust manifold temperature below a preset lower limit; a missing air valve driver pulse; or the closure of the air valve to its preset limit of closure.

If the alarm circuit 816 is activated, it energizes the horn 817 so as to produce an audible alarm signal. The alarm circuit 816 also sends a signal to the air valve driver 444, causing it to open the air valve 66 to its maximum open position, where it remains until the alarm circuit 816 is deactivated by operating the alarm reset switch 818. The activation of the alarm circuit 816 also puts the remainder of the control system 80 into a standby status, so that the vapor-generating unit 98 is deenergized.

When the alarm circuit 816 is reset, the audible alarm horn 870 is silenced. After a short delay, the air valve 66 is closed partially, to a position determined by the operational limiter circuit 554 of FIG. 14. The short delay is for the purpose of truly ascertaining that no additional alarm circuit activation is forthcoming. If no further alarm situation develops, the control system is returned to normal operation.

The furnace boiler 42 of FIG. 1 is a standard, forced-draft, two-pass fire-tube boiler. The burner 46 is a combination burner, capable of using either natural gas or fuel oil. The conventional boiler controls, contained in the control box or unit 92, have not been modified in any way and will allow the boiler to operate in the manner in which it was designed. This particular boiler 42 is equipped with a variable fuel valve 48 controlled by load demand. The air intake valve 68 is connected by a linkage to the fuel valve 48 in a conventional configuration.

The automatic control system 74 is installed near and on the boiler equipment, the information processor 80 and the power supply and interface module are mounted adjacent to the boiler. The combustion device interface circuit board 94 is mounted in the control box 92, to carry the interface circuits 94 of FIG. 12. The exhaust manifold 58 of the boiler may be provided with the optional gas analyzer 90, having its outputs connected to the processor 80.

The exhaust manifold thermocouple 78 senses the temperature of the exhaust gases in the stack 60 and transmits a corresponding voltage to the information processor 80. The combustion chamber thermocouple 76 senses the temperature in the combustion chamber 44 and transmits a corresponding voltage to the processor 80. The fuel monitor potentiometer 226 is connected to the fuel valve stem and produces a voltage proportional to the fuel valve position, such signal being sent to the processor 80 by way of the power supply and interface module 102.

The air valve 66 is mounted in series with the standard air intake control valve 68 and is controlled by the information processor 80 through the power supply and interface module 102. The vapor generator drive module 98 is usually mounted on or in close proximity to the burner and is controlled by the information processor 80 through the power supply and interface module 102. The output of the drive module 98 is transmitted to the ultrasonic delivery head 72, which is secured to the air valve 66, and is supplied with water from any available water source. The ultrasonic delivery head 72 injects very small water droplets into the combustion air intake.

To establish a point of operation, it will be assumed that the boiler 42 has been firing for some time and has provided sufficient heat to the load demand, so that the burner has been turned off by the thermostat or other control device. Thus, the boiler is awaiting the signal to refire, which will be given by the thermostat or other standard boiler controls, as soon as the demand requires. The automatic control system 74 is in an idle or standby status.

The first event that occurs is that the load demand requires additional heat, and the operational sequence of the standard boiler controls is begun. There is acknowledgment of the demand, and the burner blower 64 is activated. The air intake control valve 68 is simultaneously rotated to its maximum open or purged position. This allows the combustion chamber 44 to be cleared of any residual combustible gases. From the start of the sequence, the automatic air valve 66 is maintained in a fully open position.

The second step in the fire-up sequence is the ignition of the fuel igniter, followed by the opening of the main fuel valve 48, so that the boiler firing begins. At this time, a signal is transmitted by the combustion device interface circuit 94 to the information processor 80, with the information that the boiler is firing and whether the boiler is in a high-fire or low-fire mode. This rate of firing is sensed by the fuel monitor circuit 650, and the information is employed by the information processor 80 to enable it to determine a preset position or set point of the air valve 66. The information processor 80 commands the air valve 66 to close to that set point, whereupon the information processor 80 goes into a standby condition.

From the time combustion begins, the combustion chamber temperature starts to rise and is sensed by the combustion thermocouple 76, which sends a corresponding voltage to the information processor 80. When the combustion chamber temperature is sufficiently high to cause the voltage to reach a preset level, the processor 80 is removed from standby and beings actively reviewing boiler data as derived from its inputs. When the boiler status has been determined, the processor 80 locks in on this data and starts to control boiler operation. The vapor-generating module 98 is now activated.

The automatic control system 74 continuously monitors the combustion chamber and exhaust manifold temperatures and internally combines the information gained from them in the processor 80. If the gas analyzer 90 is employed, the data it samples may also be integrated with the temperatures. The composite information or summation is periodically sampled, and each sample, in the form of a voltage level, is stored in the processor 80 and acts as a point of reference. When each following sample is taken, the processor 80 compares that sample with the previous one, and determines whether the voltage level has increased or decreased. If the level has increased, the boiler combustion efficiency has improved. If the level has decreased, the efficiency has declined. The automatic air valve 66 is controlled to close or open its slide gate 130 on every sample. The direction in which the air valve moves depends upon the comparison of the voltage levels. If the level has increased, the air valve will continue to move in the direction it travelled during its previous move. If the level has decreased or remained the same, the air valve will move in the opposite direction it travelled during its previous move.

If the boiler's load changes and the rate of fuel consumption is automatically increased or decreased by the standard boiler controls, the automatic control system 74 also automatically switches it set point on the air valve 66 to a new location as determined by the new fuel valve setting, and then controls the air valve 66 as before. Throughout this period of automatic control, the vapor-generating module 98 is supplying water vapor to the air intake of the boiler. The boiler 42 and the automatic control system 74 continue to operate in conjunction as long as the boiler is firing.

When the boiler's load demands are met, the standard boiler controls turn off the main fuel valve 48 and simultaneously alert the automatically control system 74 that the boiler 42 is ceasing to fire. The automatic control system 74 is returned to an idle status, its air valve slide gate 130 is again moved to its fully open position, and the vapor-generating module 98 is turned off. Both the boiler 42 and the automatic control system 74 remain in this state until the next fire-up is dictated by the load demand.

The automatic control system 74 is adapted to function within certain operational limits, which, if exceeded, will cause its control over boiler combustion efficiency to cease. These operational limits are: excessive or insufficient boiler combustion chamber temperatures, excessive or insufficient boiler exhaust manifold temperatures, overclosure of the automatic air valve 66, and an excessive time period between the input samplings of the information processor 80. If one or more of these limits is exceeded, the alarm circuit 814 of FIG. 16 is activated, the audible alarm is sounded, and the air valve slide gate 130 is caused to travel to its maximum open position. The vapor-generating module 98 is deactivated. The automatic control system 74 will remain in this alarm status until its reset switch 818 is closed, whereupon the processor 80 will again lock in on the input data from the boiler and continue to function as before.

The modified combustion system 110 of FIG. 2 is a standard boiler or furnace equipped with an atmospheric burner, adapted to use gas as its fuel. The conventional boiler controls have not been modified in any way and will allow the boiler to operate in the manner in which it was designed.

The modified combustion system 110 includes the automatic control system 74, which operates the same as described in connection with FIG. 1, with some exceptions. One exception resides in the provision of the air intake manifold 118, constituting a complete shroud, containing the fan 120 to develop an influx of air. The manifold 118 is placed around the burners 114 to enclose them completely. The automatic air valve 66 and the vapor delivery head 72 are mounted at the air intake of the manifold 118. A second exception resides in the fact that the information processor 80 does not require a fuel monitor.

The operation of the modified system 110 is the same as described in connection with FIG. 1, except that the fan 120 is operated in place of the burner blower 64.

I claim:

1. Combustion control apparatus, comprising combustion chamber means having a combustion chamber therein, combustion means for causing the combustion of fuel in said combustion chamber, heat exchanger means connected with said combustion chamber for deriving useful heat from the combustion therein, exhaust means connected with said heat exchanger means for removing the waste products of combustion from said heat exchanger means and said combustion means, fuel supply means for supplying fuel to said combustion means, variable air supply means for supplying a variable amount of air to said combustion means for supporting the combustion of the fuel therein, combustion temperature measuring means for measuring the combustion temperature in said combustion chamber and for producing a first quantity corresponding in magnitude to said combustion temperature, exhaust temperature measuring means for measuring the exhaust temperature in said exhaust means and for producing a second quantity corresponding in magnitude to said exhaust temperature, summation means for producing a summation quantity comprising a summation of said first and second quantities, and control means connected to said variable air supply means for varying the air supplied to said combustion means in such manner as to maximize said summation quantity, whereby the combustion efficiency is also maximized.

2. Combustion control apparatus according to claim 1, said combustion temperature measuring means including means for producing said first quantity in the form of a first voltage, said exhaust temperature measuring means including means for producing said second quantity in the form of a second voltage, said summation means including means for producing said summation quantity in the form of a summation voltage constituting a summation of said first and second voltages.

3. Combustion control apparatus according to claim 2, said control means comprising means for sampling said summation voltage periodically, means for storing each sample summation voltage to form a reference voltage, power means for changing said variable air supply means in one direction or the other to increase or decrease the air supply for each sampling interval, means for comparing each summation voltage with the reference voltage for the preceding sample, and direction determining means for operating said power means in the same direction as for the preceding sample if the current summation voltage exceeds the reference voltage while operating said power means in the opposite direction if the current summation voltage is less than the reference voltage for the previous sample.

4. Combustion control apparatus according to claim 1, said control means comprising sampling means for sampling said summation quantity at periodic sampling intervals, storage means for storing each sample summation quantity to provide a reference quantity, comparison means for comparing each sample summation quantity with the previous reference quantity to determine whether each summation quantity is greater or less than the previous reference quantity, power means for operating said variable air supply means in one direction or the other to increase or decrease the air supply during each sampling interval, and direction determining means for operating said power means in the same direction as previously if said comparison means determines that said summation quantity is greater than the previous reference quantity while operating said power means in the opposite direction to that of the previous instance if said comparison means determines that the summation quantity is less than the previous reference quantity.

5. Combustion control apparatus according to claim 1, including a water injection device for injecting finely divided water into the combustion air supply, and means for energizing said water injection device in response to at least one of said first and second quantities in response to the attainment of a predetermined temperature level.

6. A method of combustion control in a combustion system, comprising a combustion chamber, combustion means for causing the combustion of fuel in said chamber, a heat exchanger connecting with said combustion chamber, an exhaust passage connected with said heat exchanger, and fuel supply means for supplying fuel to said combustion means, said method comprising measuring the combustion temperature in said combustion chamber and producing a first quantity corresponding in magnitude with said combustion temperature, measuring the exhaust temperature in said exhaust passage and producing a second quantity corresponding in magnitude with said exhaust temperature, producing a summation of said first and second quantities and thereby producing a summation quantity, and varying the supply of air to said combustion means in such manner as to maximize said summation quantity, whereby the combustion efficiency is also maximized.

7. A method according to claim 6, including the steps of sampling said summation quantity at periodic sampling intervals, storing each sample summation quantity to provide a reference quantity, comparing each sample summation quantity with the previous reference quantity to determine whether each summation quantity is greater or less than the previous reference quantity, varying the supply of air by a predetermined step during each sampling interval in one direction or the other to increase or decrease the supply of air, and determining the direction of such variation so that such variation is in the same direction as during the previous interval if the current summation quantity is greater than the previous reference quantity but is in the opposite direction from the previous direction if the current summation quantity is less than the previous reference quantity.

8. A method according to claim 6, in which said first quantity is produced in the form of a first electrical signal, said second quantity being produced in the form of a second electrical signal, said summation quantity being produced in the form of a summation electrical signal.

9. A method according to claim 8, including the steps of sampling said summation electrical signal at periodic sampling intervals, storing each sample summation electrical signal to provide a reference electrical signal, comparing each current summation electrical signal with the previous reference electrical signal to determine whether the current summation electrical signal is greater or less than the previous reference electrical signal, varying the supply of air by a differential amount in one direction or the other to increase or decrease the supply of air by such differential amount during each sampling interval, and determining such direction to be the same as during the previous sampling interval if the current summation electrical signal is greater than the previous reference electrical signal while determining such direction to be the opposite relative to the previous direction if the current summation electrical signal is less than the previous reference electrical signal.

10. A method according to claim 6, including the step of injecting finely divided water into the supply of air to said combustion means in response to at least one of said first and second quantities upon the attainment of a predetermined temperature level.

11. In a combustion system comprising combustion chamber means having a combustion chamber therein, heat exchanger means for deriving useful heat from said combustion chamber, exhaust means including an exhaust passage for removing the waste products of combustion from said combustion chamber, combustion means for producing a combustion of fuel in said combustion chamber, and fuel supply means for supplying fuel to said combustion means, the improvement comprising combustion temperature measuring means for measuring the combustion temperature in said combustion chamber and for producing a first quantity corresponding in magnitude with said combustion temperature, exhaust temperature measuring means for measuring the exhaust temperature in said exhaust passage and for producing a second quantity corresponding in magnitude with said exhaust temperature, summation means for producing a summation of said first and second quantities and thereby producing a summation quantity, a variable air valve for supplying a variable quantity of air to said combustion means to support the combustion of the fuel, and control means for operating said variable air valve in such a manner as to maximize said summation quantity, whereby the combustion efficiency is also maximized.

12. In a combustion system according to claim 11, said combustion temperature measuring means including means for producing said first quantity in the form of a first electrical signal, said exhaust temperature measuring means including means for producing said second quantity in the form of a second electrical signal, said summation means including means for producing said summation quantity in the form of a summation electrical signal comprising a summation of said first and second electrical signals.

13. In a combustion system according to claim 12, said control means comprising means for sampling said summation electrical signal at periodic sampling intervals, means for storing each sample summation electrical signal to form a reference electrical signal, power means for operating said variable air valve in one direction or the other to increase or decrease the air supply by a differential amount for each sampling interval, means for comparing each current summation electrical signal with the previous reference electrical signal, and direction determining means for operating said power means in the same direction as for the preceding sample if the current summation electrical signal exceeds the previous reference electrical signal while operating said power means in the opposite direction relative to the preceding interval if the current summation electrical signal is less than the reference electrical signal for the previous sample.

14. In a combustion system according to claim 11, said control means comprising sampling means for sampling said summation quantity at periodic sampling intervals, storage means for storing each sample summation quantity to provide a reference quantity, comparison means for comparing each sample summation quantity with the previous reference quantity to determine whether each current summation quantity is greater or less than the previous reference quantity, power means for operating said variable air valve by a step in one direction or the other to increase or decrease the air supply by a differential amount during each sampling interval, and direction determining means for operating said power means in the same direction as previously if said comparison means determines that the current summation quantity is greater than the previous reference quantity while operating said power means in the opposite direction relative to that of the previous interval if said comparison means determines that the current summation quantity is less than the previous reference quantity.

15. In a combustion system according to claim 11, including vapor generating means for injecting finely divided water into the combustion air, and means for energizing said vapor generating means in response to at least one of said first and second quantities upon the attainment of a predetermined temperature level.

16. In a combustion system comprising combustion chamber means having a combustion chamber therein, exhaust means including an exhaust passage for removing the waste products of combustion from said combustion chamber, combustion means for producing a combustion of fuel in said combustion chamber, and fuel supply means for supplying fuel to said combustion means, the improvement comprising combustion temperature measuring means for measuring the combustion temperature in said combustion chamber and for producing a first quantity corresponding in magnitude with said combustion temperature, exhaust temperature measuring means for measuring the exhaust temperature in said exhaust passage and for producing a second quantity corresponding in magnitude with said exhaust temperature.

summation means for producing summation of said first and second quantities and thereby producing a summation quantity, a variable air valve for supplying a variable quantity of air to said combustion means to support the combustion of the fuel, reversible power means for moving said air valve in one direction or the other to open or close said air valve, startup means for causing said power means to open said air valve under cold conditions while causing said power means to partially close said air valve to a startup position in response to at least one of said first and second quantities upon the attainment of a predetermined temperature level, operational control means for thereafter sampling said summation quantity at sampling intervals, storage means for storing each sampled summation quantity to provide a reference quantity, stepping means for causing said power means to move said air valve through a step in one direction or the other during each sampling interval to open or close the air valve by such step, comparison means for comparing each current summation quantity with the previous reference quantity to determine whether the current summation quantity is greater or less than the previous reference quantity, and direction determining means for causing said stepping means to produce movement of said air valve in the same direction as during the previous interval if the current summation quantity is greater than the previous reference quantity while causing said stepping means to move the air valve in the opposite direction relative to the preceding interval if the current summation quantity is less than the previous reference quantity, whereby the summation quantity and the combustion efficiency are maximized.

17. In a combustion system according to claim 16, said fuel supply means comprising fuel varying means for varying the fuel supply rate, and means for changing said startup position of said air valve in response to the variation of the fuel supply rate by said fuel varying means.

18. In a combustion system according to claim 17, including means for causing said power means to open said air valve fully in response to at least one of said first and second quantities upon the attainment of a temperature exceeding a high temperature limit.

* * * * *